US011705620B2

(12) United States Patent
Anguera Pros et al.

(10) Patent No.: US 11,705,620 B2
(45) **Date of Patent: *Jul. 18, 2023**

(54) GROUND PLANE BOOSTER ANTENNA TECHNOLOGY FOR WEARABLE DEVICES

(71) Applicant: Fractus Antennas, S.L., Barcelona (ES)

(72) Inventors: Jaume Anguera Pros, Vinaros (ES); Aurora Andujar Linares, Barcelona (ES)

(73) Assignee: IGNION, S.L., Barcelona (ES)

( * ) Notice: Subject to any disclaimer, the term of this patent is extended or adjusted under 35 U.S.C. 154(b) by 177 days.

This patent is subject to a terminal disclaimer.

(21) Appl. No.: 16/887,689

(22) Filed: May 29, 2020

(65) Prior Publication Data

US 2020/0295441 A1 Sep. 17, 2020

Related U.S. Application Data

(63) Continuation of application No. 15/499,551, filed on Apr. 27, 2017, now Pat. No. 10,734,713.

(60) Provisional application No. 62/328,073, filed on Apr. 27, 2016.

(51) Int. Cl.

| | |
|---|---|
| ***H01Q 1/27*** | (2006.01) |
| ***H01Q 1/48*** | (2006.01) |
| ***H01Q 9/04*** | (2006.01) |
| ***H01Q 1/52*** | (2006.01) |
| ***H01Q 1/24*** | (2006.01) |

(52) U.S. Cl.

CPC ..... *H01Q 1/273* (2013.01); *H01Q 1/245* (2013.01); *H01Q 1/48* (2013.01); *H01Q 1/526* (2013.01); *H01Q 9/0407* (2013.01)

(58) Field of Classification Search

CPC ..... H01Q 1/243; H01Q 1/48; H01Q 1/526; H01Q 9/0407; H01Q 1/245; H01Q 1/2283; H01Q 1/36; H01Q 9/0414; H01Q 9/0421; H01Q 9/06

See application file for complete search history.

(56) References Cited

U.S. PATENT DOCUMENTS

| | | | |
|---|---|---|---|
| 6,061,024 | A | 5/2000 | McGirr et al. |
| 6,121,930 | A | 9/2000 | Grangeat et al. |
| 6,133,880 | A | 10/2000 | Grangeat et al. |

(Continued)

FOREIGN PATENT DOCUMENTS

| | | | |
|---|---|---|---|
| CN | 205303668 | U | 6/2016 |
| DE | 10204877 | A1 | 8/2003 |

(Continued)

OTHER PUBLICATIONS

Plicanic, V. Antenna diversity studies and evaluation, Master of Science Thesis, Lund University, Sweden, May 2004, p. 23.

(Continued)

*Primary Examiner* — David E Lotter

(74) *Attorney, Agent, or Firm* — Edell, Shapiro & Finnan, LLC

(57) ABSTRACT

A wireless wearable device comprises a radiating system that contains at least a non-resonant element disposed in different arrangements within a radiating structure in the radiating system, featuring compact dimensions and an adequate performance when operating on a carrier living body.

19 Claims, 25 Drawing Sheets

(56) References Cited

U.S. PATENT DOCUMENTS

| | | | | |
|---|---|---|---|---|
| 6,535,170 | B2 | 3/2003 | Sawamura et al. | |
| 6,549,169 | B1 | 4/2003 | Matsuyoshi et al. | |
| 6,784,844 | B1 | 8/2004 | Boakes et al. | |
| 6,885,880 | B1 | 4/2005 | Ali | |
| 6,940,460 | B2 | 9/2005 | Maoz et al. | |
| 7,042,414 | B1 | 5/2006 | Lee | |
| 7,069,043 | B2 | 6/2006 | Sawamura et al. | |
| 7,075,484 | B2 | 7/2006 | Sung | |
| 7,229,385 | B2 | 6/2007 | Freeman et al. | |
| 7,663,556 | B2 | 2/2010 | Desclos et al. | |
| 7,768,462 | B2 | 8/2010 | Zhang et al. | |
| 7,876,274 | B2 | 1/2011 | Hobson et al. | |
| 8,270,914 | B2 | 9/2012 | Pascolini et al. | |
| 8,665,164 | B2 | 3/2014 | Hill et al. | |
| 9,054,418 | B2 | 6/2015 | Soler Castany et al. | |
| 9,331,389 | B2 | 5/2016 | Anguera Pros et al. | |
| 10,236,561 | B2 | 3/2019 | Anguera Pros et al. | |
| 10,367,927 | B2 | 7/2019 | Shamsoddini et al. | |
| 10,411,364 | B2 | 9/2019 | Anguera Pros et al. | |
| 10,734,713 | B2 * | 8/2020 | Anguera Pros | H01Q 1/36 |
| 2003/0169207 | A1 | 9/2003 | Beigel | |
| 2003/0216793 | A1 | 11/2003 | Karlsson et al. | |
| 2004/0032371 | A1 | 2/2004 | Mendolia et al. | |
| 2005/0083233 | A1 * | 4/2005 | He | H01Q 9/0407 343/700 MS |
| 2006/0250310 | A1 | 11/2006 | Yeh et al. | |
| 2010/0188300 | A1 | 7/2010 | Anguera et al. | |
| 2011/0117976 | A1 * | 5/2011 | Nishikido | H01Q 9/40 343/700 MS |
| 2013/0342416 | A1 | 12/2013 | Andujar Linares et al. | |
| 2014/0002321 | A1 | 1/2014 | Soler Castany et al. | |
| 2014/0015728 | A1 * | 1/2014 | Anguera Pros | H01Q 1/243 343/843 |
| 2014/0180365 | A1 | 1/2014 | Perryman et al. | |
| 2014/0191912 | A1 | 7/2014 | Darden, IV et al. | |
| 2015/0048981 | A1 | 2/2015 | Choi et al. | |
| 2015/0091732 | A1 | 4/2015 | Hsiao | |
| 2015/0229022 | A1 | 8/2015 | Soler Castany et al. | |
| 2016/0218419 | A1 | 7/2016 | Vance | |
| 2018/0159206 | A1 | 6/2018 | Coles et al. | |
| 2018/0254546 | A1 | 9/2018 | Shamsoddini | |
| 2020/0119433 | A1 | 4/2020 | Ashwood et al. | |

FOREIGN PATENT DOCUMENTS

| | | | |
|---|---|---|---|
| EP | 0735609 | A1 | 10/1996 |
| EP | 0753897 | A2 | 1/1997 |
| EP | 0749176 | B1 | 9/2002 |
| EP | 2978069 | A1 | 1/2016 |
| GB | 2494922 | A | 3/2013 |
| KR | 20150072714 | A | 6/2015 |
| WO | 9424722 | A1 | 10/1994 |
| WO | 9424723 | A1 | 10/1994 |
| WO | 9603783 | A1 | 2/1996 |
| WO | 0159877 | A1 | 8/2001 |
| WO | 0235646 | A1 | 5/2002 |
| WO | 03026064 | A1 | 3/2003 |
| WO | 2004047222 | A1 | 6/2004 |
| WO | 2016198820 | A1 | 12/2016 |
| WO | 2018031185 | A1 | 2/2018 |

OTHER PUBLICATIONS

Matsushima, H. et al., Electromagnetically coupled dielectric chip antenna, IEEE Antennas and Propagation Society International Symposium, Jun. 21-26, 1998.

Salonen, P.; Keskilammi, M.; Kivikoski, M., New slot configuration for dual-band planar inverted-F antenna, Microwave and Optical Technology Letters, vol. 28, No. 5, Mar. 5, 2001.

Kivekas, O. et al., Bandwidth, SAR, and efficiency of internal mobile phone antennas, IEEE Transactions on Electromagnetic Compatibility, vol. 46, No. 1, Feb. 2004.

Sanad, M.; Hassan, N., An internal integrated microstrip antenna for PCS/cellular telephones and other hand-held portable communication equipment, Microwave Journal, vol. 41, No. 7, Jul. 1998.

Alomainy, A. et al., Comparison between two different antennas for UWB on-body propagation measurements, IEEE Antennas and Wireless Propagation Letters, vol. 4, Jun. 2005.

Klemm, M.; Troester, G., Textile UWB antennas for wireless body area networks, IEEE Transactions on Antennas and Propagation, vol. 54, No. 11, Nov. 2006.

Icheln, C., Methods for measuring RF radiation properties of small antennas, Helsinki University of Technology Radio Laboratory Publications, Report S 250, Oct. 2001, p. 18-22.

Kivekäs, O., Design of high-efficiency antennas for mobile communications devices, Helsinki University of Technology Radio Laboratory Publications, Report S 272, Aug. 2005, p. 30-31.

Ollikainen, J., Design and implementation techniques of wideband mobile communications antennas, Helsinki University of Technology Radio Laboratory Publications, Report S 266, Nov. 2004, p. 27-37.

Villanen, J., Miniaturization and evaluation methods of mobile terminal antenna structures, Helsinki University of Technology Radio Laboratory Publications, Report S 290, Sep. 2007.

Causley, A. J., Design of conformal antennas for telephone handsets, University of Queensland, Oct. 2002.

Sanad, M.; Hassan, N., Compact wide-band microstrip antennas for PCS and cellular phones, IEEE-APS Conference on Antennas and Propagation for Wireless Communications, Nov. 1-4, 1998.

Song, P.T.C., Novel antenna design for future mobile systems, University of Birmingham, May 2001, ch.3, p. 2-9.

Morishita, H. et al., Characteristics of a balance-fed loop antenna system for handsets in the vicinity of human head or hand, IEEE Antennas and Propagation Society International Symposium, Jul. 16-21, 2000.

Huynh, M.C.T., A Numerical and Experimental Investigation of Planar Inverted-F Antennas for Wireless Communication Applications, Virginia Polytechnic Institute and State University, Oct. 2000.

Gobien, A.T., Investigation of Low Profile Antenna Designs for Use in Hand-Held Radios, Virginia Polytechnic Institute and State University, Aug. 1997, p. 10, 34, 61-66, 185-195.

See, T.S.P.; Chen, Z.N., Effects of human body on performance of wearable PIFAs and RF transmission, IEEE Antennas and Propagation Society International Symposium, Jul. 3-8, 2005.

Bonefacic, D.; Rapinac, B.; Bartolic, J., Slotted PIFA for GSM Band, The Second European Conference on Antennas and Propagation (EuCAP), Nov. 11-16, 2007.

Rehman, M.U., Effects of human body interference on the performance of a GPS antenna, The Second European Conference on Antennas and Propagation (EuCAP), Nov. 11-16, 2007.

Adel, H.; Wansch, R.; Schmidt, C., Antennas for a body area network, IEEE Antennas and Propagation Society International Symposium, Jun. 22-27, 2003.

Liu, Z.D. ; Hall, P.S.; Wake, D., Dual-frequency planar inverted-F antenna, IEEE Transactions on Antennas and Propagation, vol. 45, No. 10, Oct. 1997.

Tanaka, M.; Jang, J.H., Wearable microstrip antenna, IEEE Antennas and Propagation Society International Symposium, Jun. 22-27, 2003.

Solbach, K., Antennas for communication, Universität Duisburg-Essen, Aug. 2006, p. 134-138.

Nchewah, A., Towards conformal antennas for miniaturized autarchic distributed sytems, Technische Universität Berlin, 2006, p. 49.

Godara, L.C., Handbook of Antennas in Wireless Communications, CRC Press, 2002, chs. 6.3.2 and 6.6.

Heberling, D., Course Antenna Engineering Wir Aopert Micro Strip 01, 2014, p. 55.

Kawahata, K.; Miyata, A.; Ishikawa, Y, A miniaturized dielectric ceramics resonator antenna for mobile handset application, Jan. 2002.

Houzen, T.; Takahashi, M.; Ito, K., Implanted antenna for an artificial cardiac pacemaker system, Progress In Electromagnetics Research Symposium (PIERS), Prague, Czech Republic, Aug. 27-30, 2007.

(56) References Cited

OTHER PUBLICATIONS

Ebrahimi-Ganjeh, M.A.; Attari, A.R, Interaction of dual band helical and PIFA handset antennas with human head and hand, Progress In Electromagnetics Research, PIER 77, 2007.
Poutanen, J., Interaction between mobile terminal antenna and user, Helsinki University of Technology, Sep. 2007, p. 26-28, 41-46, 73-94.
Looi, C.K., See, T.S.P., Chen, Z.N., Study of human head effects on the planar inverted-F antenna, IWAT 2005. IEEE International Workshop on Antenna Technology: Small Antennas and Novel Metamaterials, Mar. 7-9, 2005.
Li, Z.; Rahmat-Samii, Y., Optimization of PIFA-IFA combination in handset antenna designs, IEEE Transactions on Antennas and Propagation, vol. 53, No. 5, May 2005.
Salim, T.; Hall, P.S., Efficiency measurement of antennas for on-body communications, 2006.
Khan, I.; Hall, P.S., Multiple antenna reception at 5.8 and 10 GHz for body-centric wireless communication channels, IEEE Transactions on Antennas and Propagation, vol. 57, No. 1, Jan. 2009.
Aberle, J.T. et al., Reconfigurable antennas for wireless devices, IEEE Antennas and Propagation Magazine, vol. 45, No. 6, Dec. 2003.
Gao, Y. et al., Design and performance investigation of a dual-element PIFA array at 2.5 GHz for MIMO terminal, IEEE Transactions on Antennas and Propagation, vol. 55, No. 12, Dec. 2007.
Fujimoto, K. et al., Small Antennas, Research Studies Press Ltd., England, Oct. 1993, pp. 116-117.
Kim, J.H.; Lee, H.M., Low specific absorption rate wearable antenna for WLAN band applications, Proceedings of the Fourth European Conference on Antennas and Propagation (EuCAP), Apr. 12-16, 2010.
Kildal, P.S. et al., Report on the state of the art in small terminal antennas: Technologies, requirements and standards, ACE, Dec. 2004, p. 30-35.
Rajagopalan, H.; Rahmat-Samii, Y., Conformal RFID antenna design suitable for human monitoring and metallic platforms, Proceedings of the Fourth European Conference on Antennas and Propagation (EuCAP), Apr. 12-16, 2010.
Azad, M.Z.; Ali, M., A miniaturized implantable antenna for GPS application, IEEE Antennas and Propagation Society International Symposium, Jul. 2006.
Lindsey, P. et al., Antenna design methodology for smartwatch applications, Microwave Journal, Feb. 2017.
Su, S.W.; Hsieh, Y.T., Integrated Metal-Frame Antenna for Smartwatch Wearable Device, IEEE Transactions on Antennas and Propagation, vol. 63, No. 7, Jul. 2015.
Mohamed, A.E.; Sharawi, M.S., Miniaturized dual-wideband circular patch antenna for biomedical telemetry, 11th European Conference on Antennas and Propagation (EuCAP), Mar. 19-24, 2017.
Chen, X.; Ying, Z., Small Antenna Design for Mobile Handsets (part I), Sony Ericsson, Mar. 2009.
Aun, N.F.M., Revolutionizing Wearables for 5G, IEEE Microwave Magazine, vol. 18, No. 3, May 2017.
Allabouche, K., Use of a dielectric resonator antenna to reduce hand effect in a miniature IoT device, 11th European Conference on Antennas and Propagation (EuCAP), Mar. 19-24, 2017.
Ku, T.Y., Chen, Y.S., Wearable antenna design on finite-size high impedance surfaces for smart-watch applications, IEEE International Symposium on Antennas and Propagation & USNC/URSI National Radio Science Meeting, Jul. 19-24, 2015.
Rackley, R., Folkert, M., Antennas for Medium-Frequency Broadcasting, Encyclopedia of RF and Microwave Engineering, Apr. 2005.
Abbas, S. M.; Esselle, K. P.; Ranga, Y., An armband-wearable printed antenna with a full ground plane for body area networks, IEEE Antennas and Propagation Society International Symposium (APSURSI), Memphis, TN, 2014, pp. 318-319.
Anguera, J., et al., "Behavior of several antenna topologies near the human head at the 2.4-2.5 GHz band," Microwave and optical technology letters, vol. 54, No. 8, p. 1911-1916 (Aug. 2012).
Azad, M. Z., and M. Ali, "A miniature implanted inverted-F antenna for GPS application," IEEE Transactions on Antennas and Propagation, vol. 57, No. 6, p. 1854-1858 (Jun. 2009).
Casula, G. A.; Michel, A.; Nepa, P.; Montisci, G.; Mazzarella, G., Robustness of Wearable UHF-Band PIFAs to Human-Body Proximity, in IEEE Transactions on Antennas and Propagation, vol. 64, No. 5, pp. 2050-2055, May 2016.
Chen, Z. N., et al., "Small planar UWB antennas in proximity of the human head," IEEE Transactions on Microwave Theory and Techniques, vol. 54, No. 4, p. 1846-1857 (Apr. 2006).
Cihangir, A., "Antenna designs using matching circuits for 4G communicating devices," Thesis, Université Nice Sophia Antipolis, 144 pp. (2014).
Conway, G., and W. Scanlon, "Antennas for over-body-surface communication at 2.45 GHz," IEEE Transactions on Antennas and Propagation, vol. 57, No. 4, p. 844-855 (Apr. 2004).
Genovesi, S.; Costa, F.; Fanciulli, F.; Monorchio, A., Wearable Inkjet-Printed Wideband Antenna by Using Miniaturized AMC for Sub-GHz Applications, in IEEE Antennas and Wireless Propagation Letters, vol. 15, pp. 1927-1930, 2016.
Giddens, H.; Paul, D. L.; Hilton, G. S.; McGeehan, J. P., Influence of body proximity on the efficiency of a wearable textile patch antenna, 6th European Conference on Antennas and Propagation (EUCAP), Prague, 2012, pp. 1353-1357.
Golio, M., editor, "The RF and microwave handbook," Book, 1356pp., CRC Press, Boca Raton, ISBN 0-8493-8592-X (2001).
Hall, P., and Y.Hao, editors, "Antennas and propagation for body-centric wireless communications," contents, Artech House, Boston, 7 pp. (2006), ISBN 978-1-58053-493-2.
Ivšić, B.; Bonefačić, D.; Bartolić, J., Design and performance of miniaturized wearable antennas in UHF band, The 8th European Conference on Antennas and Propagation (EuCAP 2014), The Hague, 2014, pp. 1556-1560.
Kaivanto. E., et al., "Circularly polarized textile antenna for personal satellite communication," Proceedings of the Fourth European Conference on Antennas and Propagation (EuCAP), Barcelona, Spain, Apr. 12-16, 2010, 4p., ISSN 2164-3342.
Kellomaki, T., et al., "2.4 GHz plaster antennas for health monitoring," Proceedings of the 3rd European Conference on Antennas and Propagation (EuCAP), Berlin, Germany, Mar. 23-27, 2009, p. 211-215, ISSN 2164-3342.
Khouri, R.; Ratajczak, P.; Brachat, P.; Staraj, R., A thin surface-wave antenna using a via-less EBG structure for 2.45 GHz ON-Body communication systems, Proceedings of the Fourth European Conference on Antennas and Propagation, Barcelona, 2010, pp. 1-4.
Kim, J., "Implanted antennas for medical wireless communications: characterizations, designs and performance evaluations," dissertation, University of California, 184 pp. (2005).
Klemm, M., et al., "Novel small-size directional antenna for UWB WBAN/WPAN applications," IEEE Transactions on Antennas and Propagation, vol. 53, No. 12, p. 3884-3896 (Dec. 2005).
Ouyang, Y., and W. Chappell, "Diversity characterization of body-worn textile antenna system at 2.4 GHz," IEEE Antennas and Propagation Society International Symposium, Jul. 9-14, 2006, p. 2117-2120, ISBN 1-4244-0123-2.
Salonen, P., and L. Sylanheimo, "Development of an S-band flexible antenna for smart clothing," IEEE Antennas and Propagation Society International Symposium, San Antonio Texas, USA,Jun. 16-21, 2002, vol. 3 ,p. 6-9, ISBN 0-7803-7330-8.
Salonen, P., et al., "Dual-band and wide-band PIFA with U- and meanderline-shaped slots," Antennas and Propagation Society International Symposium, p. 116-119, vol. 2,(Jul. 8-13, 2001) IEEE, ISBN 0-7803-7070-8.
See, T., and Z. Chen, "Experimental characterization of UWB antennas for on-body communications" IEEE Transactions on Antennas and Propagation, vol. 57, No. 4, p. 866-873 (Apr. 2009).
Shakhirul, M. S.; Jusoh, M.; Ismail, A. H.; Kamarudin, M. R.; Rahim, H. A.; Sabapathy, T., Reconfigurable frequency with circular polarization for on-body wearable textile antenna, 10th European Conference on Antennas and Propagation (EuCAP), Davos, 2016, pp. 1-4.
Sim, D., et al., "Design of novel dipole-type tag antennas using electromagnetic bandgap (EBG) surface for passive RFID applica-

(56) References Cited

OTHER PUBLICATIONS tions," IEEE Antennas and Propagation Society International Symposium, Jun. 9-15, 2007, p. 1333-1336, ISBN 978-1-4244-0877-1.
Soh. P. J., et al., "Wearable wireless health monitoring", IEEE Microwave Magazine, p. 55-70 (May 2015), ISSN 1527-3342.
Strydom, M., and M. Rütschlin, "Embedded dual-band GSM antenna design," Application Note, Germany, CST AG, 6 pp. (2014).
Sun, Y. Y.; Liu, L.; Cheung, S. W.; Yuk, T. I., UWB antenna using offset feeding and slotted ground plane for on-body communications, 2013 International Workshop on Antenna Technology (iWAT), Karlsruhe, 2013, pp. 332-335.
Tanaka, M., and J. Jang, "Wearable microstrip antenna" IEEE Antennas and Propagation Society International Symposium, Jun. 22-27, 2003, p. 704-707, ISBN 0-7803-7846-6.
Tang, I., et al., "Compact five-band meandered PIFA by using meandered slots structure," Antennas and Propagation Society International Symposium, Jun. 9-15, 2007, p. 653-656, IEEE, ISBN 978-1-4244-0877-1.
Valle Fernández, J., "Study of an energy transmission system through RF," Universitat Politècnica de Catalunya 95 pp. (Feb. 2006).
Van Torre, P., et al., "Diversity textile antenna systems for firefighters" Proceedings of the Fourth European Conference on Antennas and Propagation (EuCAP), Barcelona, Spain, Apr. 12-16, 2010, 5p., ISSN 2164-3342.
Wang, J., "Broadband omnidirectional helmet antennas," IEEE Antennas and Propagation Society International Symposium, Jul. 9-14, 2006, p. 2129-2132, ISBN 1-4244-0123-2.
Weii 2.4 GHz Ceramic Antenna, product specification, DS-SRC W004-1.0, 20p., Antenova M2M (2015).
Yan, S.; Poffelie, L. A. Y.; Soh, P. J.; Zheng, X.; Vandenbosch, G. A. E., On-body performance of wearable UWB textile antenna with full ground plane, 10th European Conference on Antennas and Propagation (EuCAP), Davos, 2016, pp. 1-4.
Yuce, M., and T. Dissayanake, "Easy-to-swallow wireless telemetry," IEEE Microwave Magazine, p. 90-101 (Sep.-Oct. 2012), ISSN 1527-3342.
Picher, C., Multiband handset antennas with slotted ground planes: human head interaction, Universitat Ramon Llul (presentation), 2009.
Alomainy, A.; Hao, Y.; Pasveer, F., Antennas for Wearable Devices, Antennas for portable devices, John Wiley & Sons, 2007, pp. 197-229.
Andújar, A. et al., Distributed antenna systems for wireless handheld devices robust to hand loading, IEEE Transactions on Antennas and Propagation, vol. 60, No. 10, Oct. 2012.
Andújar, A. et al., Human head interaction over ground plane booster antenna technology: functional and biological analysis, Progress In Electromagnetics Research B, vol. 41, Mar. 2012.
Andújar, A., Ground plane booster antenna technology for wireless handheld devices, Universitat Politècnica de Catalunya, May 2013.
Anguera, J. et al., Advances in antenna technology for wireless handheld devices, International Journal on Antennas and Propagation, vol. 2013, Article ID 838364, Mar. 2013.
Anguera, J. et al., Comparison of several antenna topologies near the Human Head: a 2.4GHz case Study, IEEE Antennas and Propagation Society International Symposium, Jul. 11-17, 2010.
Arenas , J.J., Análisis y diseño de antenas diferenciales para dispositivos inalámbricos, Universitat Politècnica de Catalunya, Dec. 2007, ch. 3.5, p. 108-116.
Barrio, S.C.D., Tunable Antennas to Address the LTE Bandwidth Challenge on Small Mobile Terminals: One World, One Radio, Department of Electronic Systems, Aalborg University, 2013, pp. 68-69, 91-93, 115-116.
Bhatti, R.A.; Im, Y.T.; Park, S.O., Compact PIFA for mobile terminals supporting multiple cellular and non-cellular standards, IEEE Transactions on Antennas and Propagation, vol. 57, No. 9, Sep. 2009.
Camps, A., Sistema distribuido de antenas para dispositivos móviles/wireless, Universitat Ramon Llull—La Salle, Nov. 2007, ch. 4, 114-134.
Casanovas, O., Análisis de parámetros electromagnéticos de las antenas de telefonía móvil, Universitat Ramon Llull—La Salle, 2008.
Cobo, Y., Sistema de antenas distribuido robusto al cuerpo humano para dispositivos de telefonía móvil, Universitat Ramon Llull—La Salle, Nov. 2010, p. 78-95.
Cobo, Y., MIMO system combining a PIFA antenna and ground plane booster antenna technology, Universitat Ramon Llull—La Salle, Jul. 2014.
Díaz, V., Técnicas de antenas miniatura multibanda robustas a la proximidad del cuerpo humano para dispositivos de telefonía móvil, Universitat Ramon Llull—La Salle, 2010, p. 89-131.
Dumanli, S., A wrist wearable dual port dual band stacked patch antenna for wireless information and power transmission, 10th European Conference on Antennas and Propagation (EuCAP), IEEE, 2016.
Fujimoto, K., Antennas for mobile communications, Encyclopedia of RF and Microwave Engineering, John Wiley & Sons, 2005, pp. 324, 355, 357.
González, L., Antenna characterization in material media and their interaction with the human head (presentation), Universitat Politècnica de Catalunya, Jul. 2008.
González, L., Caracterización de antenas en medios materiales y su interacción con la cabeza humana, Universitat Politècnica de Catalunya, Jun. 2008, ch. 3.2.2, p. 62-64.
Hallberg, L., Tunable WWAN/LTE handset antenna and its LTE MIMO application, Chalmers University of Technology, 2012.
Kwak, S.I. et al., Design of multilayer PIFA based on an EBG structure for SAR reduction in mobile applications, Asia Pacific Microwave Conference, Dec. 7-10, 2009.
Kwak, S.I., Sim, D.U., Kwon, J.H., SAR reduction on a mobile phone antenna using the EBG structures, 38th European Microwave Conference, Oct. 27-31, 2008.
Leiva, J. L., Electric and magnetic ground plane booster for MIMO antenna systems, Universitat Ramon Llull-La Salle, 2014, p. 18.
Leiva, J.L., Analisis y diseño de sistemas distribuidos de antenas robustos a los efectos de la mano, Universitat Ramon Llull—La Salle, 2011, ch. 4, p. 118-158.
Li, H. et al., Characteristic mode based tradeoff analysis of antenna-chassis interactions for multiple antenna terminals, IEEE Transactions on Antennas and Propagation, vol. 60, No. 2, Feb. 2012.
Manteuffel, D. et al., Fundamental aspects for the design of low-SAR mobile phones, IEE AMS-2002—Technical Seminar on Antenna Measurement and SAR, 2002.
Morishita, H.; Kim, Y.; Fujimoto, K., Analysis of handset antennas in the vicinity of the human body by the electromagnetic simulator, IEICE Transactions on Electronics, vol. E84-C, No. 7, Jul. 2001.
Morishita, H., A study on compact antennas and antenna miniaturization for handsets, Proceedings of International Workshop on Antenna Technology (iWAT), Mar. 4-6, 2008.
Pablos, J.; Molina, F., Techniques to reduce the mutual coupling and to improve the isolation between antennas in a diversity system, Aalborg University, Jan. 2010, p. 16-21.
Picher, C., Análisis del efecto del plano de masa en antenas multibanda y miniatura para teléfonos móviles: la técnica FracPlane@, Universitat Ramon Llull, 2006.
Picher, C., Mejora de la sensibilidad e incorporación del servicio FM en antennas de telefonía móvil, Universitat Ramon Llull—La Salle, 2009.
Picher, C. et al., Reuse of the mobile communication antenna for FM reception, Proceedings of the 5th European Conference on Antennas and Propagation (EuCAP), Apr. 11-15, 2011.
Pladevall, A., Some thoughts on human body effects on handset antenna at the FM band, Progress In Electromagnetics Research M, vol. 19, Sep. 2011.
Rahola, J.; Ollikainen, J., Optimal antenna placement for mobile terminals using characteristic mode analysis, First European Conference on Antennas and Propagation (EuCAP), Nov. 6-10, 2006.

(56) References Cited

OTHER PUBLICATIONS

Risco, S. et al., Comparison of a monopole and a PIFA handset antenna in the presence of the human head, Microwave and Optical Technology Letters, vol. 54, No. 2, Feb. 2012.
Sanad, M., Effect of the human body on microstrip antennas, Proceedings of IEEE Antennas and Propagation Society International Symposium and URSI National Radio Science Meeting, Jun. 20-24, 1994.
Secmen, M., Multiband and Wideband Antennas for Mobile Communication Systems, Electrical and Electronics Engineering Department, Yasar University, 2011, p. 115.
Stutzman, W.L.; Thiele, G.A., Antenna Theory and Design, 3rd edition, John Wiley & Sons, 2013, pp. 475-477, 502-505, 523-531.
Torres, C., Sistemas de diversidad para dispositivos de telefonía mó vil, Universitat Ramon Llull—La Salle, 2008, p. 46-50.
Valkonen, R., Impedance matching and tuning of non-resonant mobile terminal antennas, Aalto University, Doctoral Dissertations 40/2013, Mar. 2013, p. 27-36.
Vergé s, J., FM antenna techniques for handset/wireless devices, Universitat Ramon Llull—La Salle, 2007.
Woo, S. et al., Design of a compact UWB diversity antenna for WBAN wrist-watch applications, Proceedings of the International Symposium on Antennas & Propagation, Oct. 23-25, 2013.
Wu, C.H. et al., Conformal bluetooth antenna for the watch-type wireless communication device application, IEEE Antennas and Propagation Society International Symposium, Jun. 9-15, 2007.
Zervos, T. et al., The influence of MIMO terminal user's hand on channel capacity, First European Conference on Antennas and Propagation (EuCAP), Nov. 6-10, 2006.
Zhang, J. et al., Aperture-coupled wearable antenna with miniature feeding network, 11th European Conference on Antennas and Propagation (EuCAP), Mar. 19-24, 2017.
Zhang, S. et al., Mutual coupling reduction of two PIFAs with a T-shape slot impedance transformer for MIMO mobile terminals, IEEE Transactions on Antennas and Propagation, vol. 60, No. 3, Mar. 2012.
Zhao, K., SAR study for smart watch applications, IEEE Antennas and Propagation Society International Symposium (APSURSI), Jul. 6-11, 2014.
Chen, Y. et al., Evaluation of Adaptive Impedance Tuning for Reducing the Form Factor of Handset Antennas, in IEEE Transactions on Antennas and Propagation, vol. 63, No. 2, pp. 703-710, Feb. 2015.
Ilvonen, J. et al, Design Strategy for 4G Handset Antennas and a Multiband Hybrid Antenna, Transactions on antennas and propagation, vol. 62, No. 4, IEEE, pp. 1918-1927, Apr. 2014.
FXP830.07.0100C Datasheet, Taoglas Antenna Solutions, May 2020.

* cited by examiner

GROUND PLANE BOOSTER ANTENNA TECHNOLOGY FOR WEARABLE DEVICES

CROSS REFERENCE TO RELATED APPLICATIONS

This application is a continuation of U.S. patent application Ser. No. 15/499,551 filed Apr. 27, 2017, which claims the benefit of U.S. Provisional Application Ser. No. 62/328,073, filed Apr. 27, 2016, the entire contents of which are hereby incorporated by reference.

TECHNICAL FIELD

The present disclosure relates to a wireless wearable device comprising a radiating system that contains at least a non-resonant element disposed in different arrangements within a radiating structure in the radiating system, featuring compact dimensions and an adequate performance when operating on a carrier living body.

BACKGROUND

The present disclosure relates to the field of wireless devices, and more concretely wearable devices. Typically, a radiating system for a wireless wearable device requires a radiating structure of reduced dimensions that fits in small available spaces, with a robust radio-electric performance resistant to the interaction effect that exists with the carrier living body. More concretely, some of the challenges related to the performance robustness required for these radiating systems are adequate radiation and efficiency performances along with a matched input impedance in the target operation bands, in presence of a living body, to achieve good wireless connections when operating on the carrier body. Additionally, wearable devices provide operation in one or more frequency regions and/or bands of the electromagnetic spectrum, typically Bluetooth bands and/or Wifi and/or GPS and/or mobile bands. So, depending on the coverage bands, if the device needs to cover low bands, such for example LTE700 and/or GSM850 and/or GSM900, an additional challenge is providing enough bandwidth and efficiency at the bands, since normally the platforms of wearable devices are small to host ground planes of sizes that allow operation at low frequencies.

As mentioned before, one of the main challenges of an antenna technology used for creating wearable devices is to avoid the loss of radiation produced by the nearby carrier body. The contact or proximity of the device to the carrier body causes a loading effect and an energy loss that affect the radio-electric performance of the device when it is mounted on the carrier living body. At present, wearable solutions usually use IFA-PIFA antennas, typically for Wifi, Bluetooth or GPS applications. More recent antenna technologies, also used for designing devices for those applications, are found in the state-of-the-art, like metal-frame antennas or antennas based on HIS-PMC surfaces. In general, the dimensions of the designs found are suitable to fit in real wearable devices, but they feature poor efficiencies when operating on the carrier living body. Optimized solutions can improve the antenna efficiencies reached, but normally, those antennas are customized designs. One also finds solutions that cover mobile communications, including low-frequency bands like GSM850 and/or LTE700. The use of mobile communications is more common in smartwatch applications and the antenna solutions found to cover those communications usually use the strap as a dipole or monopole; the main limitation of these solutions is their poor efficiency when they operate on the wrist. A device related to the present disclosure comprises a radiating system of reduced dimensions that features good impedance bandwidth and an adequate antenna efficiency when placed on a carrier living body. An embodiment according to the present disclosure reduces the interaction between the device and the lossy living body. Additionally, the embodiments related to the present disclosure preserve the maximum available space to allocate other electronic components and also benefit from other advantages like for example the ease of implementation and integration of the radiating structures related to the present disclosure in different device platforms.

SUMMARY

It is an object to provide a wireless wearable device that overcomes the main drawbacks of current technologies applied to wearable devices, as described in the previous section. A wearable device totally or partially immune to the carrier body effects would be an advantageous solution when creating a device able to operate on living bodies. The configurations related to a wireless wearable device according to the present disclosure reduce the electromagnetic interaction with the carrier living body and are robust solutions with adequate efficiency performance in on-body conditions taking into account the dimensions one handles when creating a wearable device.

The present disclosure relates generally to wireless wearable devices that comprise a radiating system featuring a radiating structure that contains at least a non-resonant element instead of antenna elements to contribute to the electrical and radiation behavior of the device. The disclosure relates to several ways of arranging the at least one non-resonant element within the radiating structure, which further comprises a first ground plane layer. The radiating structure is included in the wearable device. Some features of the described devices are:

the small size of the radiating system comprised in the wearable device;

the small size of the non-resonant element, which allows the integration of the radiating system in the wearable device with minimum volume;

the arrangements of the radiating structure in the wearable device, which enable a reduction of the electromagnetic interaction between the radiating system comprised in the wearable device and the carrier living body;

the performance robustness of the radiating structure arrangements to the loading effect produced by the nearby living body and to the wearable device platform dimensions; and the radiating system arrangements are simple and ease the integration of the radiating system in the host device.

A wearable device normally features small dimensions. Such dimensions can range from the dimensions of a ring or bracelet to the dimensions of a smartwatch or a metria wearable sensor. Depending on the device platform and application, which determines the operation frequencies of the device, the available space for integrating the radiating system in the wearable device can be quite reduced. Among the most common smart wearable devices one finds devices devoted to health care applications, normally used for monitoring and prevent diseases of different nature. Also one finds smart wearable devices that cover sport and fitness applications, and devices that cover applications dedicated to attend to elderly. Other wearable devices that often include intelligence are smartwatches, which normally include operation at mobile communication bands. Other examples of wearable devices that can include wireless connectivity to become intelligent devices are jewels. Examples of jewelry susceptible to become smart wearable devices are rings, bracelets, necklaces and alike, whose dimensions can be very small relative to their connectivity operation frequencies. The arrangements of a radiating system that characterize the disclosed device fulfill the space requirements of wearable devices, as for instance but not limited to the ones mentioned before, and, particularly, of quite small devices like for example bracelets or pendants. Additionally, the small volume that the non-resonant element occupies in the radiating structure integrated in the wearable device enables reduced volumes of the smart device. Generally, the described device has reduced dimensions, meaning a maximum radiating structure length preferably smaller than 0.8 times the free-space wavelength corresponding to the highest frequency of operation of the device, or preferably smaller than 0.4 times, or preferably smaller than 0.3 times, or even preferably smaller than 0.16 times or even preferably smaller than 0.125 times the wavelength, which comprises a radiating system that includes a radiating structure that comprises at least a non-resonant element and at least a ground plane layer arranged between them in different configurations that feature adequate performance in on-body conditions.

A wireless wearable device that features a robust configuration is also an advantageous solution when an operative wearable device is sought. The robustness of a wearable device is normally evaluated by the impact of the nearby carrier-living body on the performance of the device. The impact of the loading effect of the carrier living body to the described device does not prevent the device from operating correctly in the frequency bands of interest. Additionally, the device performance does not strongly depend on its lateral dimensions.

Concerning the connectivity of smart wearable devices, these devices normally communicate to smartphones, preferably via Bluetooth because of connectivity and battery life reasons. But these devices can also connect via Wifi or mobile communications or other wireless communications. Typically, the described device covers at least a Bluetooth band or a Wifi band or a GPS band or a mobile band. In the context of this document, a frequency band or band preferably refers to a range of frequencies used by a particular communication standard, like for instance GPS standards, Wifi standards, Bluetooth standards, GSM 850, GSM 900, GSM 1800, GSM 1900, UMTS, CDMA, etc. The frequency bands are contained within at least one frequency region, a frequency region referring to a continuum of frequencies of the electromagnetic spectrum.

Some embodiments described herein refer to smart wearable devices of reduced dimensions featured by a compact radiating system configuration that comprises at least a non-resonant element disposed in an arrangement that does not include ground plane clearance, the ground plane clearance or clearance being a piece or, more concretely, an area of ground plane layer where the ground plane is removed. For those wireless wearable devices where the size is quite critical, like for instance jewels, a radiating structure arrangement without ground plane clearance is a suitable solution to fit the limitations of size. Smart wearable devices like jewels normally need to cover short-range communications that reach short distances near the carrier body. In some of the embodiments whose ground plane arrangement does not include clearance, the at least one non-resonant element is placed on the ground plane layer. The arrangement minimizes the loading effect produced by the carrier living body on the device and the electromagnetic interaction that appears between the radiating system included in the wearable device and the living body.

Other described embodiments refer to wearable devices also of reduced dimensions that cover short-range communications, which comprise at least a non-resonant element included in a radiating system arrangement that comprises a ground plane clearance that contains the non-resonant element. Typical wearable devices among those are for instance, but not limited to, health care devices, sport and fitness devices or devices dedicated to improve life to elderly. Some of the arrangements whose radiating structure includes at least a ground plane clearance comprise at least a non-resonant element placed at a distance from an edge of the ground plane layer, the distance being one of the parameters that determines the performance of these embodiments. Furthermore, in some of these examples, the clearance is minimized so that the performance achieved reaches at least a minimum target performance, for example, in terms of bandwidth and antenna efficiency.

As already mentioned, the solution proposed in the context of the present disclosure is a standard solution that does not require customization in function of the platform that allocates a radiating system as described. A device comprising a radiating structure arranged as described aforementioned requires minimum adjustments to implement the solution in different wearable devices. Additionally, the described configurations are simple and ease the integration of the solution in the host device.

Generally, in some of the embodiments the non-resonant elements are volumetric conducting pieces, used as booster or boosting elements. Examples of booster elements are described in U.S. Pat. No. 9,331,389B2, the entire disclosure of which is incorporated herein by reference, or found at http://www.fractusantennas.com/products as commercial products included in the mXTEND range of products of different sizes. Such non-resonant volumetric conductive elements comprise, in some embodiments, a top conductive surface, supported by a dielectric material piece, which is connected by at least a via to at least one additional bottom conducting surface.

Other embodiments contain non-resonant elements that comprises a top conducting surface supported by a dielectric material piece, the conducting surface connected to a feeding element.

Some embodiments comprise a radiating system integrated in a wearable device that includes a radiating structure comprising at least a non-resonant element and a first ground plane layer extended by a conductive element, usually a strip element, which normally is integrated in the device belt or strap or chain or alike. So, the wearable devices that host such a solution typically are smartwatches or, in general, devices that normally require operation at mobile communications including low-frequency bands, as for instance GSM850 or LTE700. Normally, the length of the conductive element is adjusted so that the device operates at the target frequency bands. When operation at low-frequency mobile bands is required, as for instance GSM850 (from 824 MHz to 894 MHz) or LTE700 (from 698 MHz to 746 MHz), an additional challenge appears at the lowest frequencies for achieving an adequate radio-electric performance at the frequencies.

Some embodiments further comprise a shielding element, which in some of those embodiments the shielding element includes an additional ground plane layer placed between the carrier body and the radiating structure comprised in the wearable device and located at a certain distance from a first ground plane layer comprised in the radiating structure. In some other embodiments, the shielding is connected to the first ground plane layer included in the radiating structure by a conductive element. Some of the shielded embodiments comprise at least a strip connection, like for example an element between the shielding ground plane and the first ground plane layer included in the radiating structure. Additionally, the first ground plane layer or layers comprised in some embodiments, shielded or not, is elongated by a conductive element, typically a strip.

BRIEF DESCRIPTION OF THE DRAWINGS

FIG. 8*a* presents a BAR mXTEND booster. FIG. 8*b* shows a RUN mXTEND booster.

FIG. 20*a* presents an example with a ground plane layer extended by a conductive belt of about 30 mm length. FIG. 20*b* presents an example with a ground plane layer extended by a 60 mm-diameter conductive belt of half a length. FIG. 20*c* presents an example with a ground plane layer extended by a 60 mm-diameter conductive belt of whole length.

FIG. 24*a* provides an embodiment featured by a clearance area CA of length 40 mm. FIG. 24*b* shows an embodiment featured by a clearance area CB of length 15 mm. FIG. 24*c* provides an embodiment featured by a clearance area CC of length 13 mm.

FIG. 29*a* provides an example containing an additional ground plane acting as shielding placed at 3 mm from a first ground plane layer comprised in the radiating structure. FIG. 29*b* and FIG. 29*c* provide two examples containing a shielding ground plane layer located at 5 mm and 10 mm, respectively, from a first ground plane layer comprised in the radiating structure.

FIG. 33*a* shows an example without shielding. FIG. 33*b* provides an example that comprises a shielding ground plane in the radiating structure. FIG. 33*c* provides an example that comprises a shielding ground plane connected to the first ground plane layer contained in the radiating structure.

DETAILED DESCRIPTION

Some specific examples of smart wireless wearable devices comprising a radiating system arranged according to the present disclosure, together with some performance results related to those specific examples, are provided in this section. The embodiments and results described herein are provided as examples but never with limiting purposes. A wireless wearable device according to the present disclosure contains at least a non-resonant element arranged within a radiating structure comprised in the wearable device. The non-resonant element arrangements are characterized by reduced dimensions that fit in small wearable devices. Some of those arrangements fit in very small wearable devices like for instance smart jewels, whose communication distances requirements normally are not very demanding. Other arrangements feature bigger platforms, which still remain small, suitable to be fitted in wearable devices that normally cover longer communications distances than the even smaller devices, like for example, but not limited to, health care devices, sport and fitness devices or wearable devices that cover applications dedicated to attend to elderly.

Figure 1:
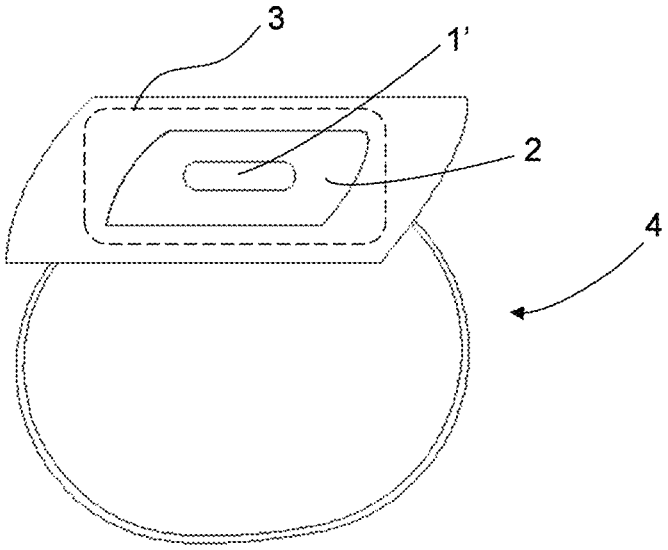
FIG. 1 shows a wireless wearable device of reduced dimensions like a smart ring, comprising a non-resonant element 1' in its radiating structure.
Figure 2:
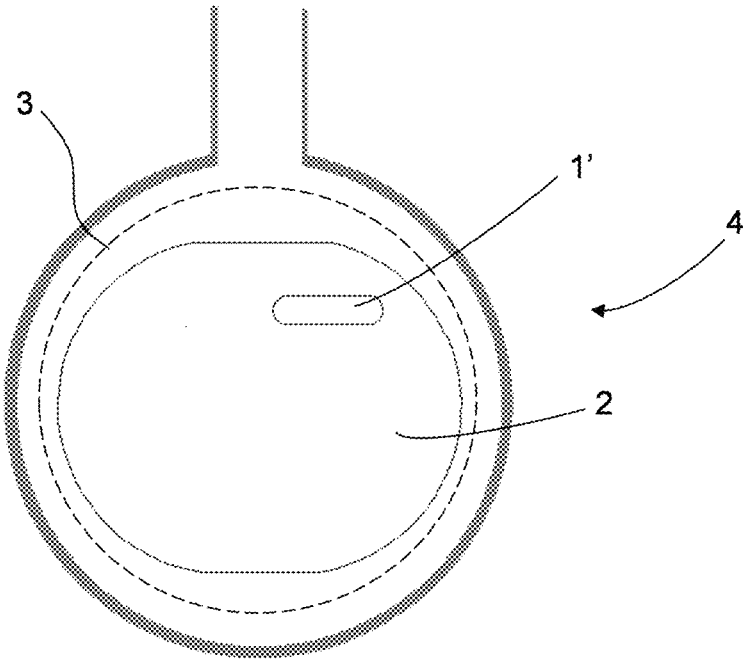
FIG. 2 provides an example of another smart jewel, a wireless pendant device comprising a non-resonant element 1' configuration similar to the one shown in FIG. 1.
Figure 3:
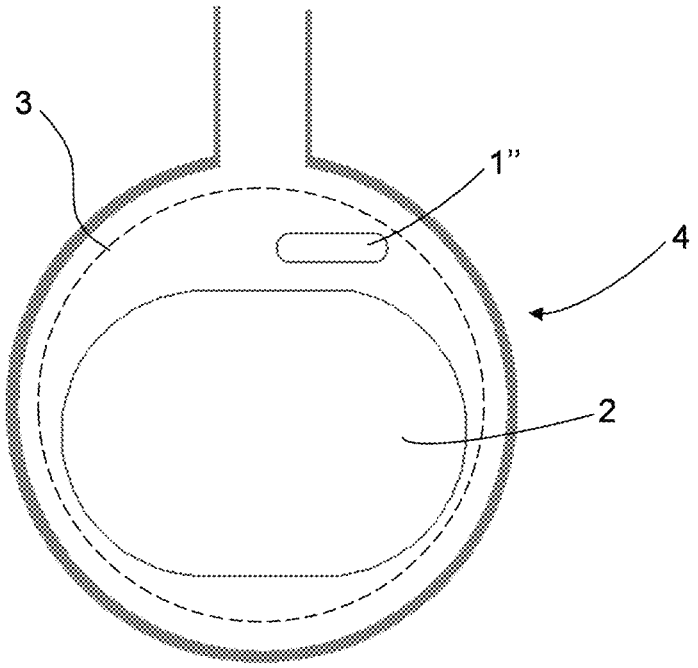
FIG. 3 provides another example of a wireless pendant device that comprises a non-resonant element 1" configuration different from the one illustrated in FIG. 2.
Figure 4:
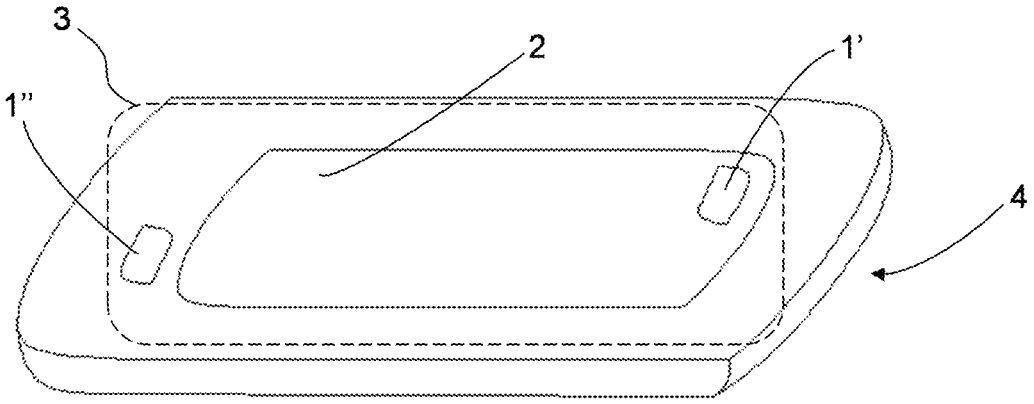
FIG. 4 shows an example of wireless wearable device as for instance a health care device, a sport or fitness device, etc., comprising a non-resonant element arranged in two possible configurations.
Figure 5:
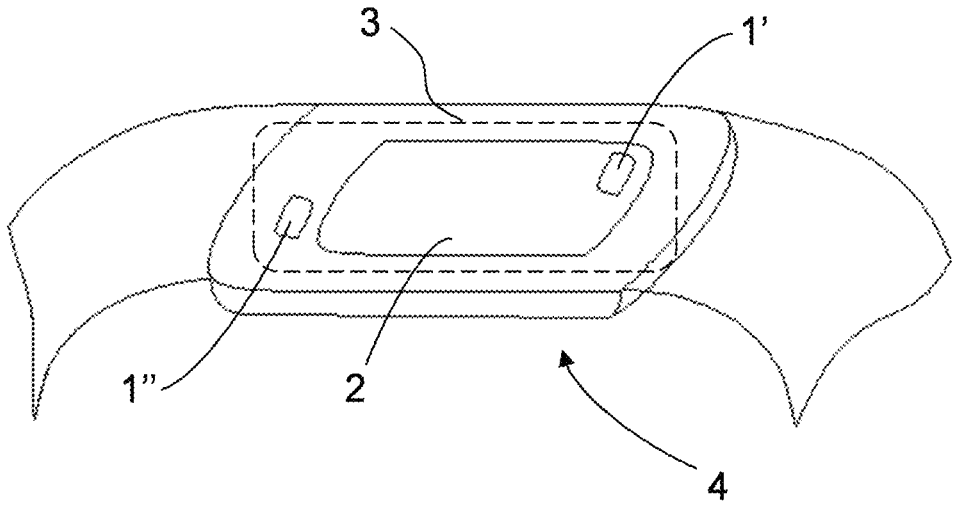
FIG. 5 shows an example of a smartwatch device that includes a non-resonant element arranged again in two possible configurations.

Referring to FIGS. 1-5, examples of wireless wearable devices are shown that comprise a radiating system featuring a radiating structure that contains at least a non-resonant element instead of antenna elements to contribute to the electrical and radiation behavior of the device. These examples demonstrate several ways of arranging the at least one non-resonant element 1' or 1" within a radiating structure 3, which further comprises a first ground plane layer 2, where the radiating structure is included in the wearable device 4. More specifically, FIG. 1 shows a wireless wearable device of reduced dimensions like a smart ring, comprising a non-resonant element 1' in its radiating structure. FIG. 2 provides an example of another smart jewel, a wireless pendant device comprising a non-resonant element 1' configuration similar to the one shown in FIG. 1. FIG. 3 provides another example of a wireless pendant device that comprises a non-resonant element 1" configuration different from the one illustrated in FIG. 2. FIG. 4 shows an example of wireless wearable device as for instance a health care device, a sport or fitness device, etc., comprising a non-resonant element arranged in two possible configurations. FIG. 5 shows an example of a smartwatch device that includes a non-resonant element arranged again in two possible configurations.

Some features of the described devices are: the small size of the radiating system comprised in the wearable device; the small size of the non-resonant element, which allows the integration of the radiating system in the wearable device with minimum volume; the arrangements of the radiating structure in the wearable device, which enable a reduction of the electromagnetic interaction between the radiating system comprised in the wearable device and the carrier living body; the performance robustness of the radiating structure arrangements to the loading effect produced by the nearby living body and to the wearable device platform dimensions; and the radiating system arrangements being simple and the ease of integration of the radiating system in the host device.

Figure 6A:
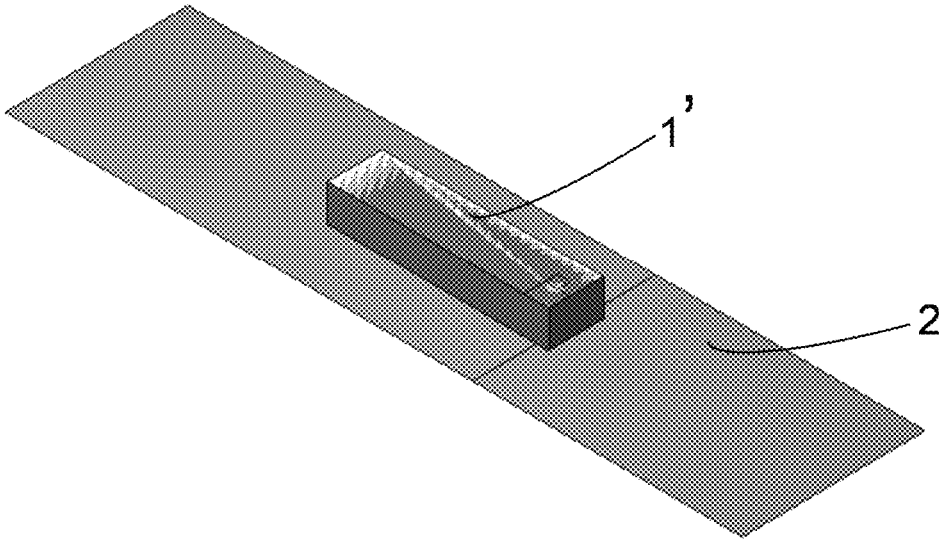
FIGS. 6*a* and 6*b* present different embodiments where at least a non-resonant element is disposed in different arrangements.
Figure 6B:
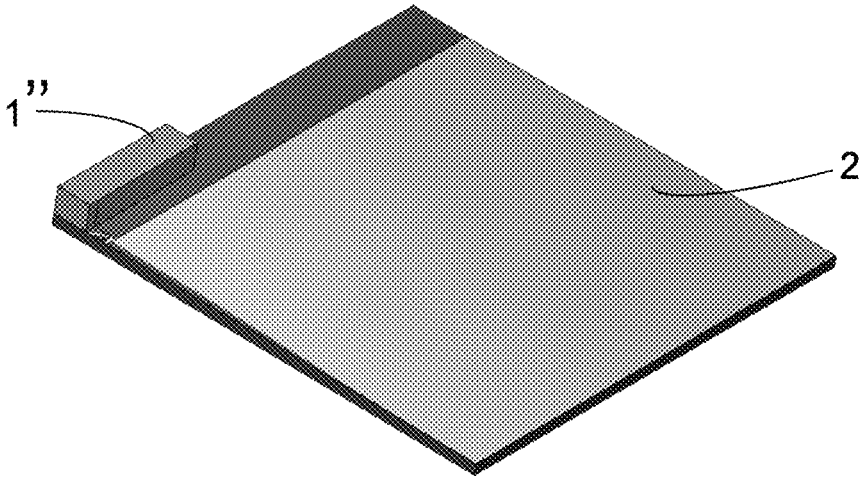
Figure 7:
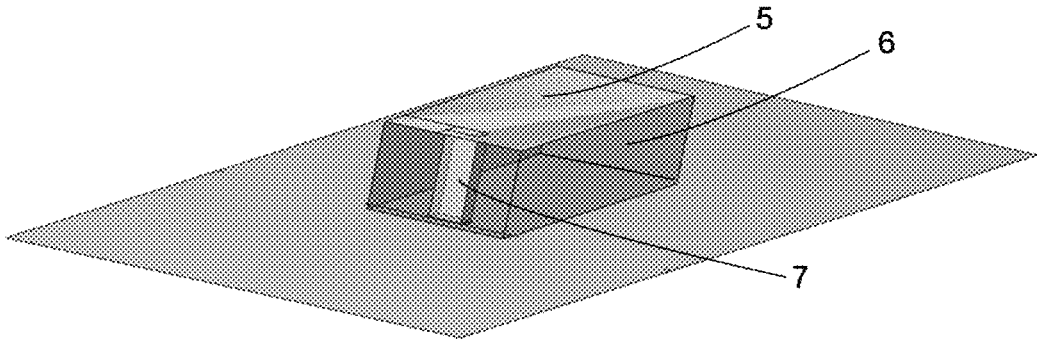
FIG. 7 provides a non-resonant element that comprises a top conducting surface supported by a dielectric piece, the conducting surface connected to a feeding element.

FIGS. 6*a* and 6*b* show different arrangements of the non-resonant element in combination with at least a ground plane layer, both comprised in the radiating structure. FIG. 6*a* provides an arrangement without ground plane clearance, wherein the non-resonant element 1' is located on the ground plane layer 2. A non-resonant element comprised in an arrangement like the one shown in FIG. 6*a* comprises a top conducting surface 5 supported by a dielectric piece 6, the conducting surface connected to a feeding element 7, typically a coaxial-probe as the one shown in FIG. 7. One of the functionalities of the ground plane layer is to reduce the electromagnetic interaction between the carrier body and the device. Such an arrangement is preferably used in very small wearable devices, featuring a maximum radiating structure length preferably smaller than 0.16 times the free-space wavelength corresponding to the highest frequency of operation of the device, or preferably smaller than 0.125 times the wavelength, such for instance rings, necklaces, bracelets, which operate at short-range communications that cover small distances near the carrier body.

Figure 8A:
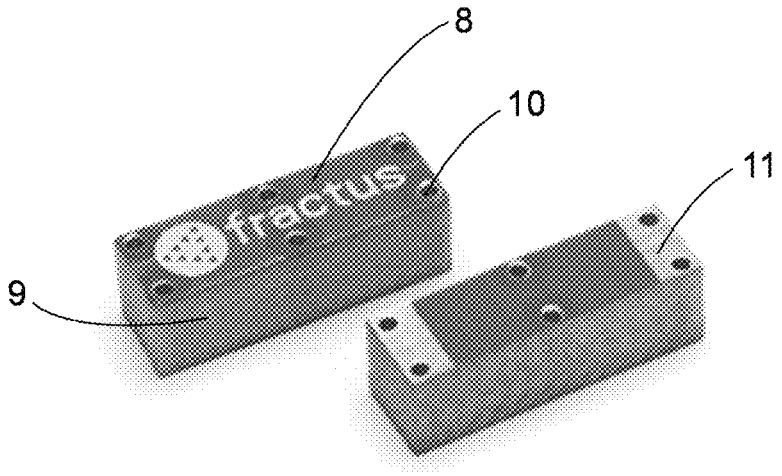
FIGS. 8*a* and 8*b* show examples of different commercial boosters.
Figure 8B:
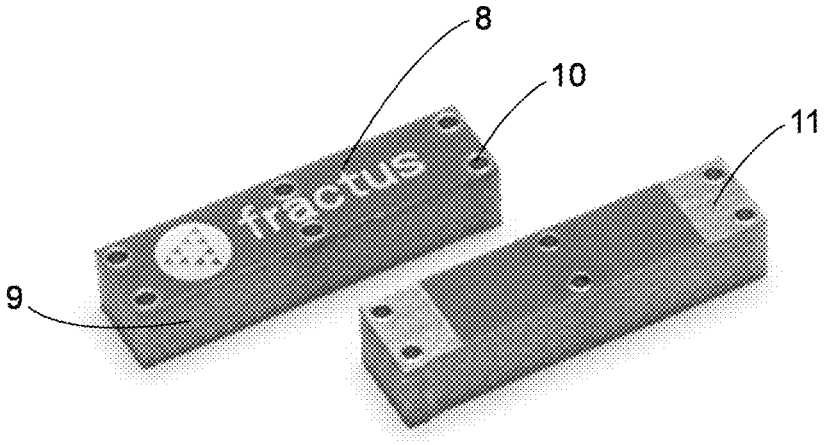

FIG. 6*b* shows an arrangement with ground plane clearance, wherein the non-resonant element 1" is located at a distance from an edge of the ground plane layer 2. Such an arrangement is preferably used in small wearable devices featuring a maximum radiating structure length preferably smaller than 0.8 times the free-space wavelength corresponding to the highest frequency of operation of the wearable device, or preferably smaller than 0.4 times, or even preferably smaller than 0.3 times the wavelength. A non-resonant element included in an arrangement like the one provided in FIG. 6*b* typically is a volumetric conducting piece, used as booster or boosting element. In some embodiments the non-resonant element comprises a top conductive surface 8, supported by a dielectric material piece 9, which is connected by at least a via 10 to at least one additional bottom conducting surface 11 (FIGS. 8*a* and 8*b*). The boosting element serves to excite at least a radiation mode into the ground plane layer included in a radiating structure like the one described in FIG. 6*b*. The boosters examples provided in FIGS. 8*a* and 8*b* correspond to commercial mXTEND boosters, used in some of the embodiments. FIG. 8*a* shows a BAR mXTEND example and FIG. 8*b* provides a RUN mXTEND booster, which features a smaller volume than the BAR mXTEND, both boosters of the mXTEND range of products. A ground plane layer comprised in a radiating structure like the one described in FIG. 6*b* contributes to the radiation of the device. The arrangement enables to cover longer distances than the configuration shown in FIG. 6*a*, providing a solution for short-range wireless communications and for longer range wireless communications normally including mobile communications.

Figure 12A:
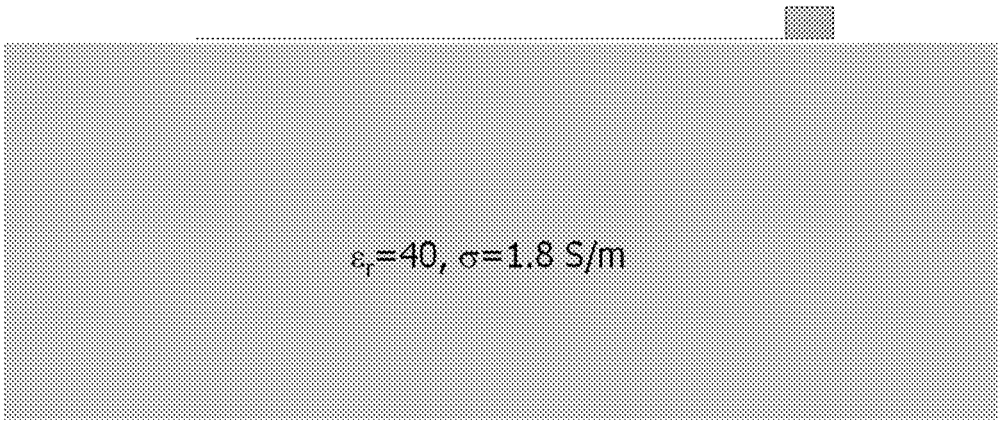
FIGS. 12*a* and 12*b* provide examples of the embodiments provided in FIGS. 6*a* and 6*b* placed on a dielectric material that plays the role of an on-body tissue.
Figure 12B:
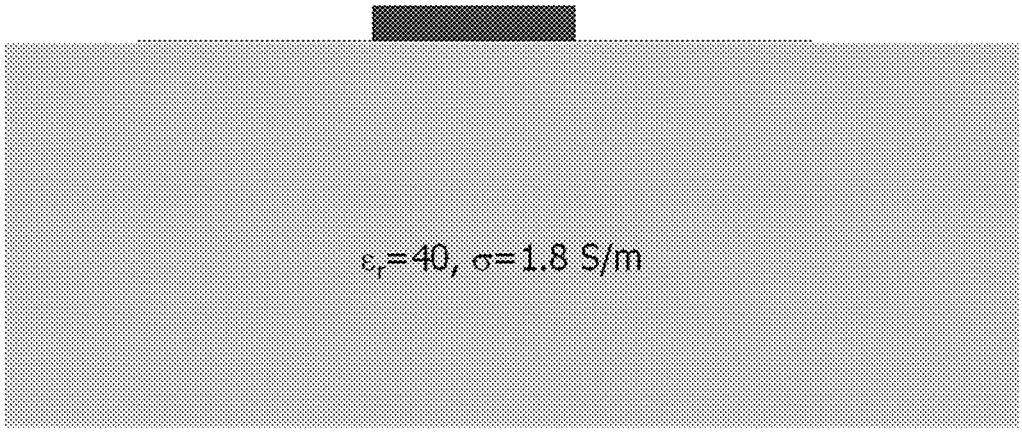
Figure 13:
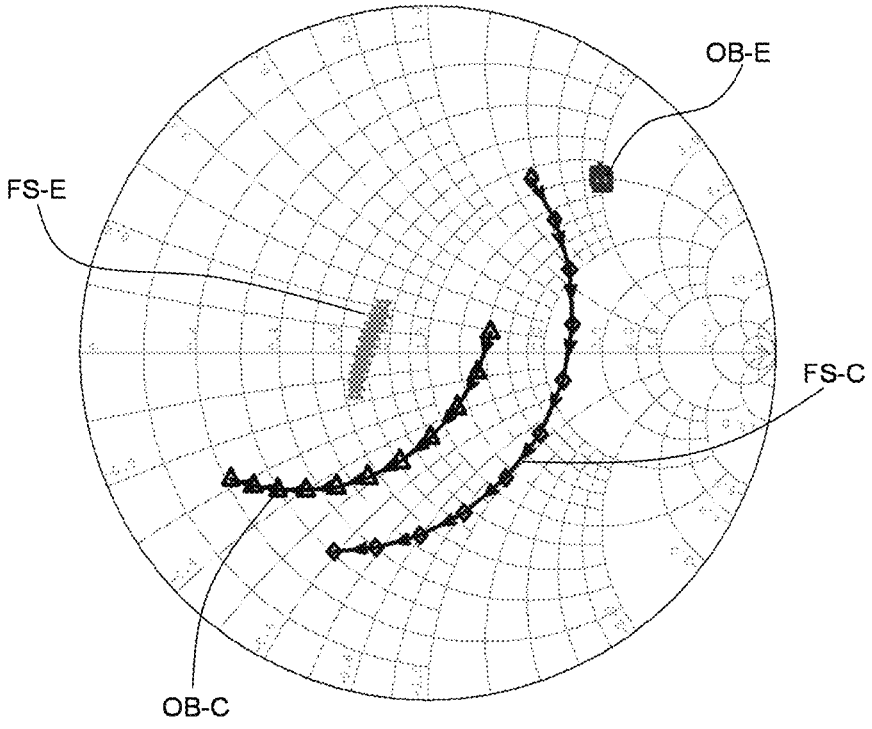
FIG. 13 shows the input reflection coefficients related to free-space 'FE' and on-body 'OB' examples configured as provided in FIGS. 6*a*, 6*b*, 12*a*, and 12*b*.
Figure 14A:
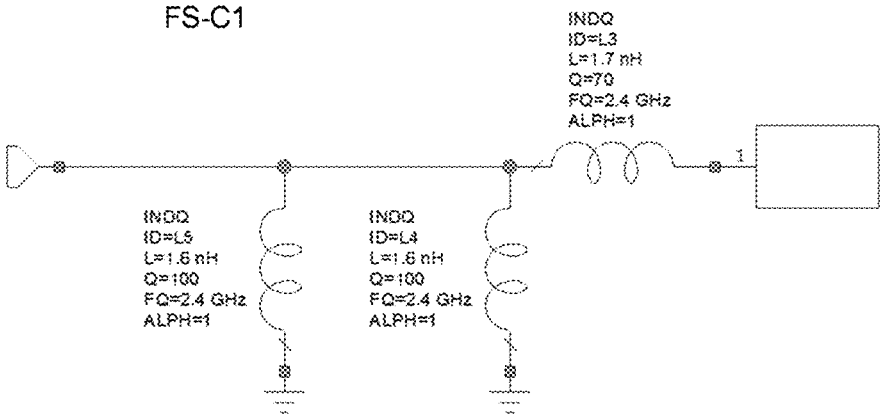
FIGS. 14*a*-14*d* provide the matching networks used to match the examples shown in FIGS. 6*a*, 6*b*, 12*a*, and 12*b*, whose input reflection coefficients are shown in FIG. 13.
Figure 14B:
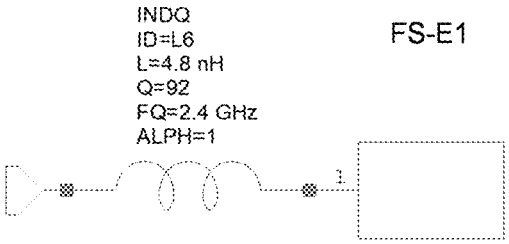
Figure 14C:
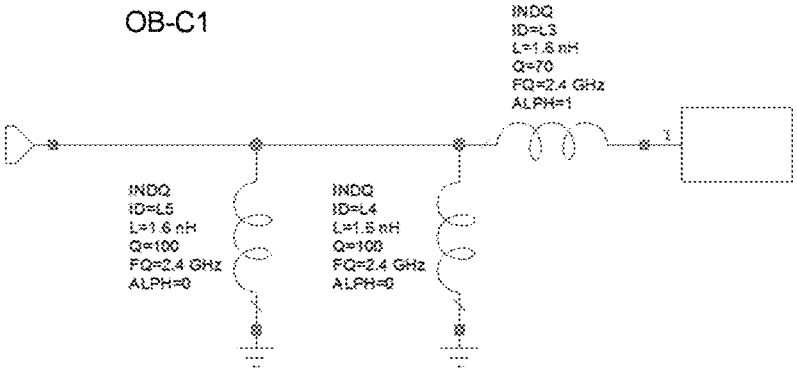
Figure 14D:
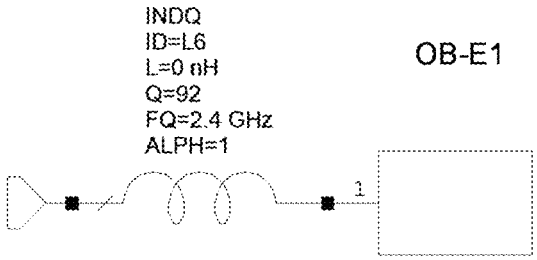

FIGS. 12*a* and 12*b* illustrate examples of the wearable device structures shown in FIGS. 6*a* and 6*b* placed on a dielectric material that plays the role of an on-body tissue. Some of the parameters that characterize the dielectric material, chosen so that it simulates the on-body tissue, are detailed in FIGS. 12*a* and 12*b*. FIG. 13 provides the input reflection coefficients related to the free-space and on-body embodiments provided in FIGS. 6*a*, 6*b*, 12*a*, and 12*b*, respectively. Such input reflection coefficients show that an arrangement like the one provided in FIG. 6*a*, whose corresponding input reflection coefficients curves are labeled as FS-C (free-space example) and OB-C (on-body example) in FIG. 13, is more robust to the effect of a nearby living body in terms of input-impedance matching performance. A free-space embodiment that contains a booster located to a distance from an edge of a ground plane layer like the one shown in FIG. 6*b* experiments a considerable mismatch when it is characterized in on-body conditions, as shown in FIG. 13 by curves FS-E and OB-E. The input reflection curves aforementioned correspond to embodiments that do not include a matching network to achieve matched examples.

Figure 15:
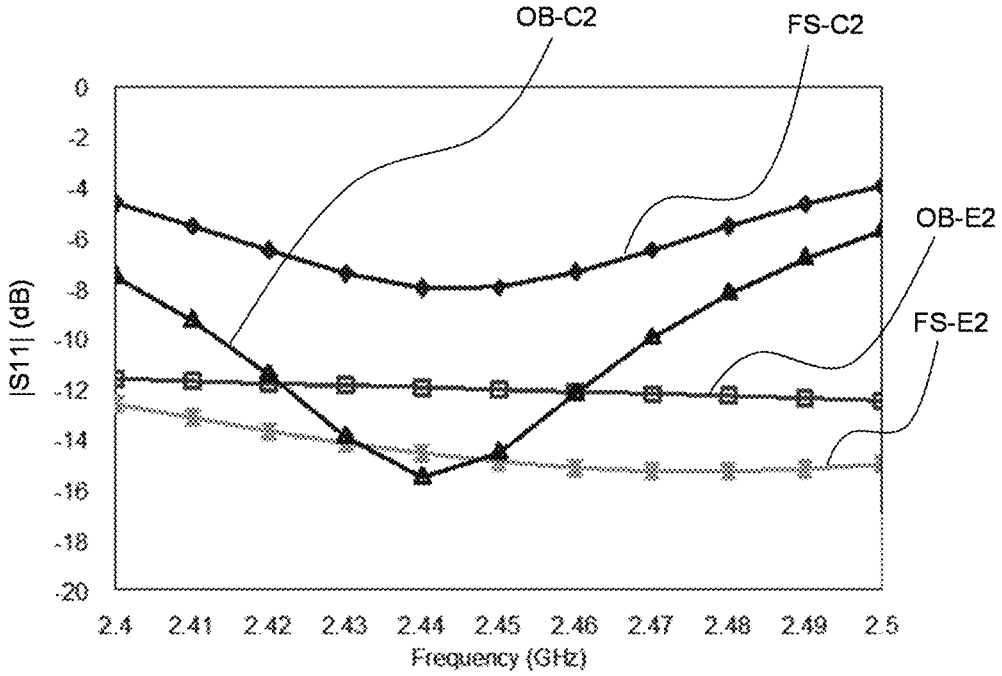
FIG. 15 provides the modules of the input reflection coefficients provided in FIG. 13, related to the free-space and on-body examples illustrated in FIGS. 6*a*, 6*b*, 12*a*, and 12*b*.
Figure 16:
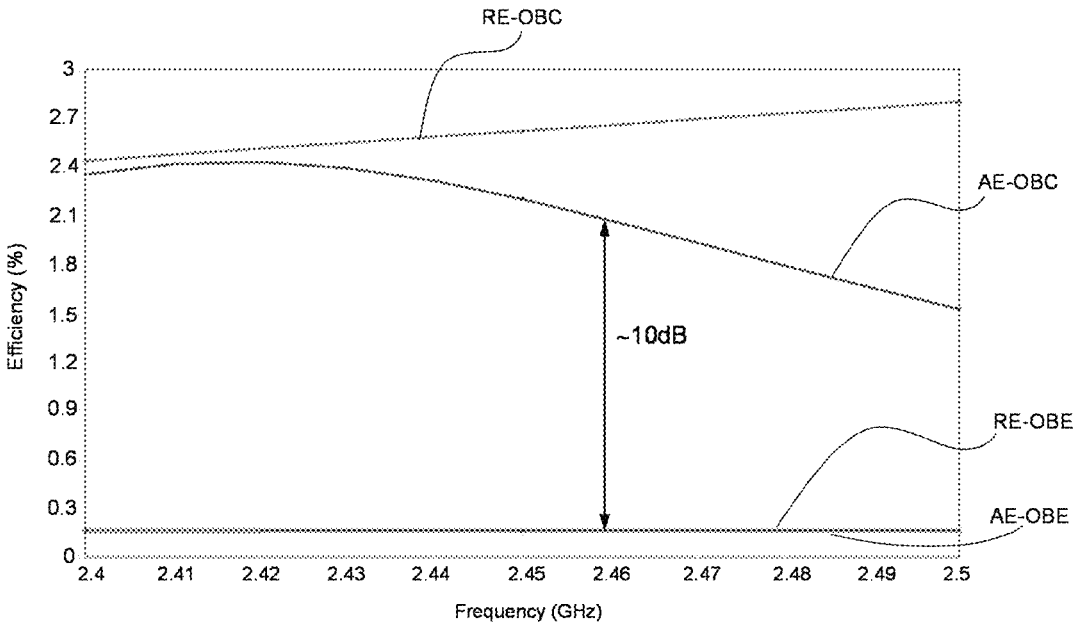
FIG. 16 provides both the radiation and the antenna efficiencies related to the on-body examples presented in FIGS. 12*a* and 12*b*.

Next, four matching networks used to match the embodiments shown in FIGS. 6*a*, 6*b*, 12*a*, and 12*b* are provided in FIGS. 14*a*-14*d*. The labels used for each matching network are chosen accordingly to the labels used for referring to each of the corresponding examples, shown in FIGS. 6*a*, 6*b*, 12*a*, and 12*b*. The modules of the input reflection coefficients related to the specific matched examples are provided in FIG. 15 and, in FIG. 16, their corresponding radiation and antenna efficiencies. The radiation and antenna efficiencies are higher for the arrangement where the non-radiating element is placed on the ground plane layer comprised in the radiating system as shown in FIG. 6*a*. In the particular examples provided and described before, a 10 dB difference in the antenna efficiency obtained for the on-body cases is evidenced between both examples.

Figure 17:
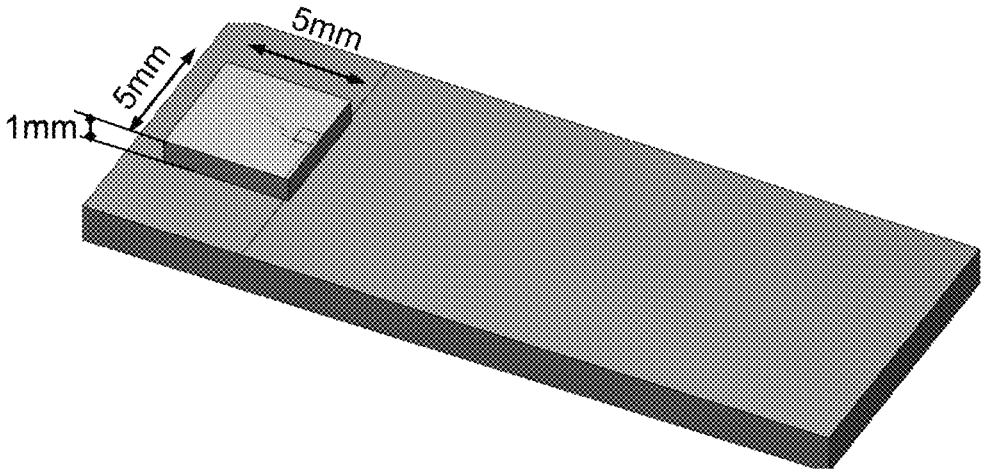
FIG. 17 includes an arrangement that comprises a non-resonant element also containing a top conducting surface supported on a dielectric substrate, the top conducting surface connected to a feeding element. The non-resonant element is placed at a non-centered position on a ground plane layer also supported by a dielectric material.
Figure 18:
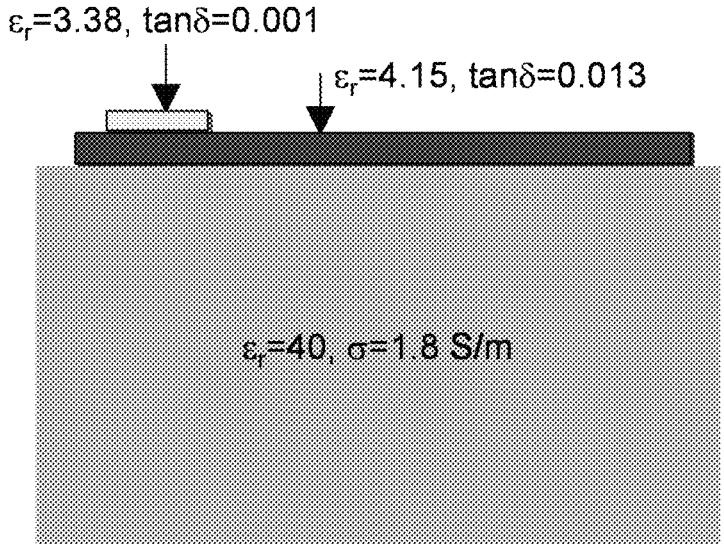
FIG. 18 shows an on-body configuration including the embodiment provided in FIG. 17. The dielectric properties of the dielectric materials used are included in the picture.
Figure 19:
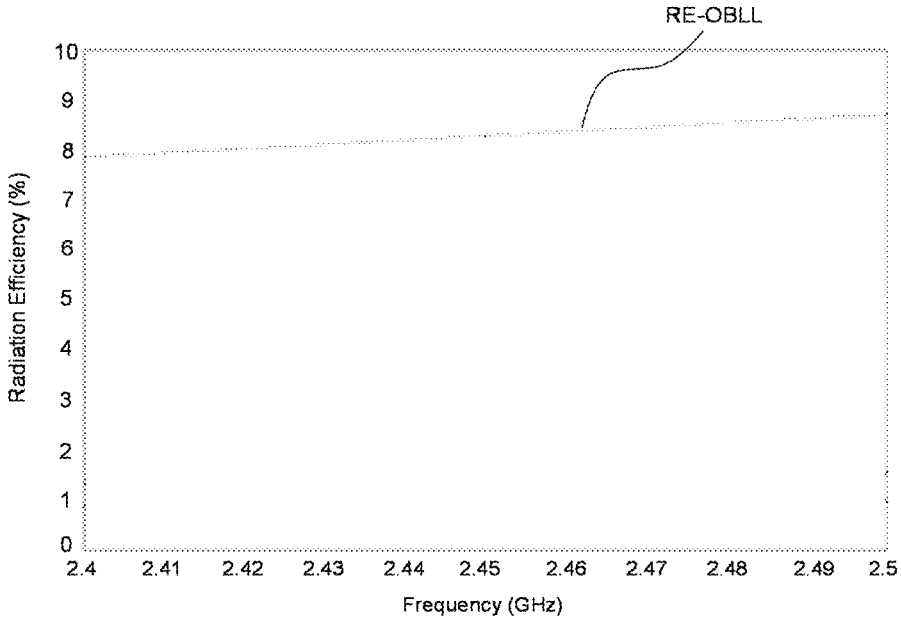
FIG. 19 presents the radiation efficiency related to the on-body configuration provided in FIG. 18.

In FIG. 17, another embodiment that comprises a non-resonant element also containing a top conducting surface supported on a dielectric substrate and the top conducting surface connected to a feeding element, is provided. The non-resonant element is placed at a non-centered position on a ground plane layer also supported by a dielectric material. In this particular embodiment, the non-resonant element is square, as shown in FIG. 17, and features a height equal to 1 mm. The ground plane layer below the non-resonant element is supported by a piece of dielectric material placed underneath. The example is characterized in on-body conditions, as shown in FIG. 18, and the radiation efficiency related to this specific example is provided in FIG. 19. The dielectric material used to support the top conducting surface is featured by low losses. The other dielectric properties used are provided in FIG. 18. The radiation efficiency related to such embodiment is improved by using a low-losses supporting dielectric material.

Figure 9:
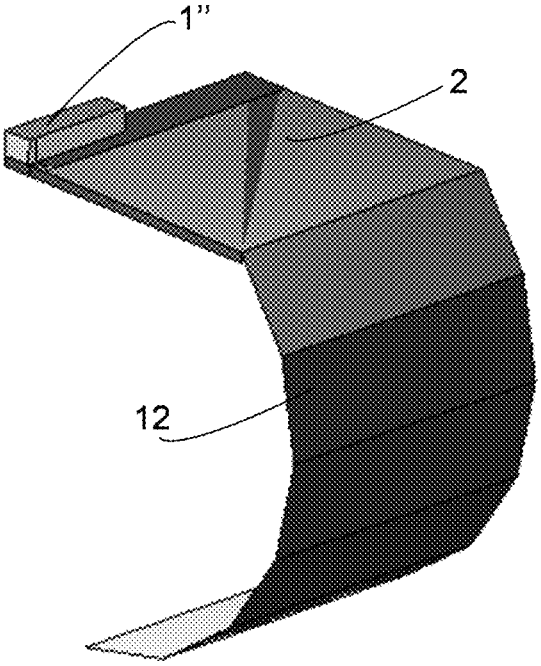
FIG. 9 illustrates an embodiment that comprises an additional ground plane layer used as a shielding element.
Figure 20A:
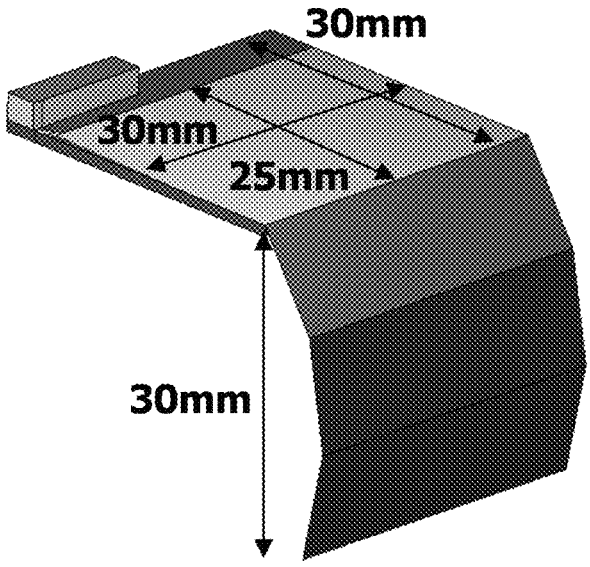
FIGS. 20*a*-20*c* present three embodiments that comprise an extended ground plane layer.
Figure 20B:
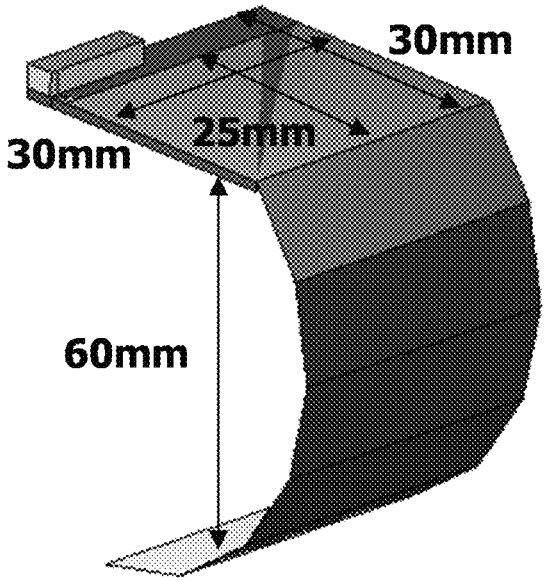
Figure 20C:
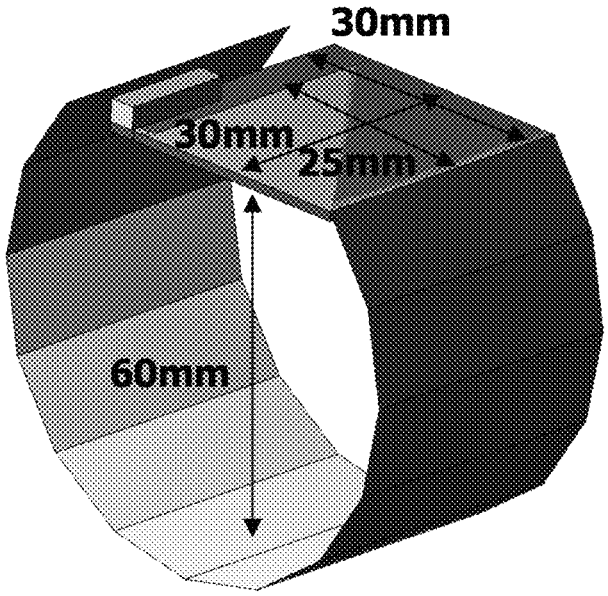

Other embodiments refer to wearable devices that usually require operation at mobile communications including low-frequency bands, devices like for instance smartwatches. Such devices comprise a radiating system, the radiating system comprising a radiating structure that comprises at least a non-resonant element 1" and at least a ground plane layer 2 extended by a conductive element 12 (FIG. 9). More concretely, FIGS. 20*a*-20*c* provide some embodiments able to operate at low-frequency mobile bands, as for example GSM900, which comprise a conductive strip that extends the ground plane layer contained in the radiating structure that is included in the wearable device, typically a smartwatch or alike, the conductive strip normally contained in the device strap. The length of the conductive strip determines the performance of the embodiments especially at low-frequencies. More specifically, FIG. 20*a* shows an embodiment wherein the conductive element is a conductive strip that measures a quarter length of the length related to a 60 mm-diameter conductive strap with a round-shape. FIG. 20*b* shows an embodiment including a conductive strip that measures half a length of the length related to a 60 mm-diameter round conductive strap. Finally, FIG. 20*c* provides an example containing a conductive element that extends the ground plane layer included in the radiating structure that features the smart device, whose length corresponds to the entire length of a 60 mm-diameter round conductive strip. The platform and ground plane layer dimensions related to the particular aforementioned examples are provided in FIG. 20 and the booster contained in those examples is a RUN mXTEND booster, shown in FIG. 8*b*.

Figure 21:
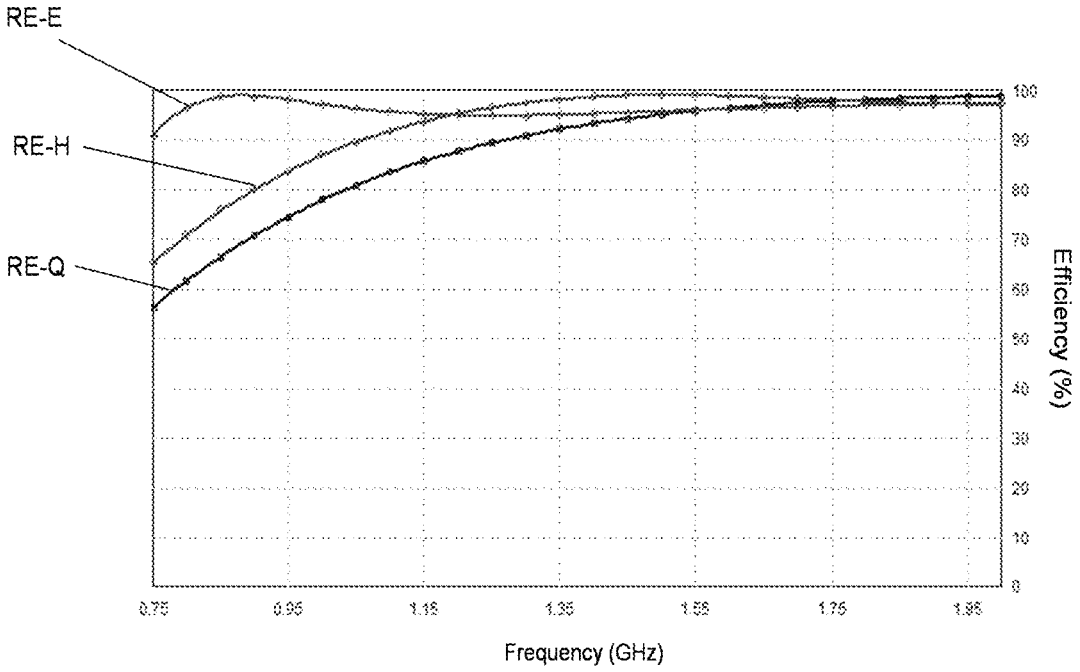
FIG. 21 provides the radiation efficiency related to the three embodiments presented in FIG. 20, which contain an extended ground plane layer of different lengths.

FIG. 21 shows the radiation efficiencies that correspond to the examples described previously and presented in FIGS. 20*a*-20*c*. The radiation efficiency obtained when the conductive strip length corresponds to the entire length of a 60 mm-diameter round strip, labeled RE-E in FIG. 21, is higher, especially at low-frequencies smaller than 1 GHz, than the radiation efficiency achieved when such conductive strip is shorter than the aforementioned length. The curve RE-H shows that better radiation efficiencies are achievable when the conductive strip is half a length of the length related to a 60 mm-diameter round strap than when it is a quarter length, the corresponding radiation efficiency curve labeled RE-Q in FIG. 21.

Figure 22:
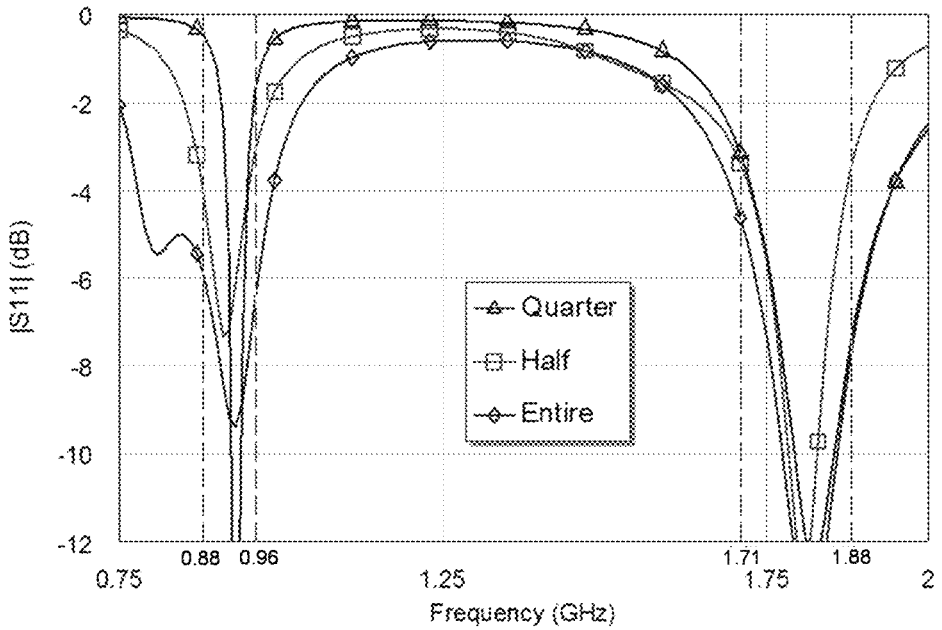
FIG. 22 represents the input reflection coefficients that correspond to the three embodiments presented in FIGS. 20*a*-20*c*.
Figure 23:
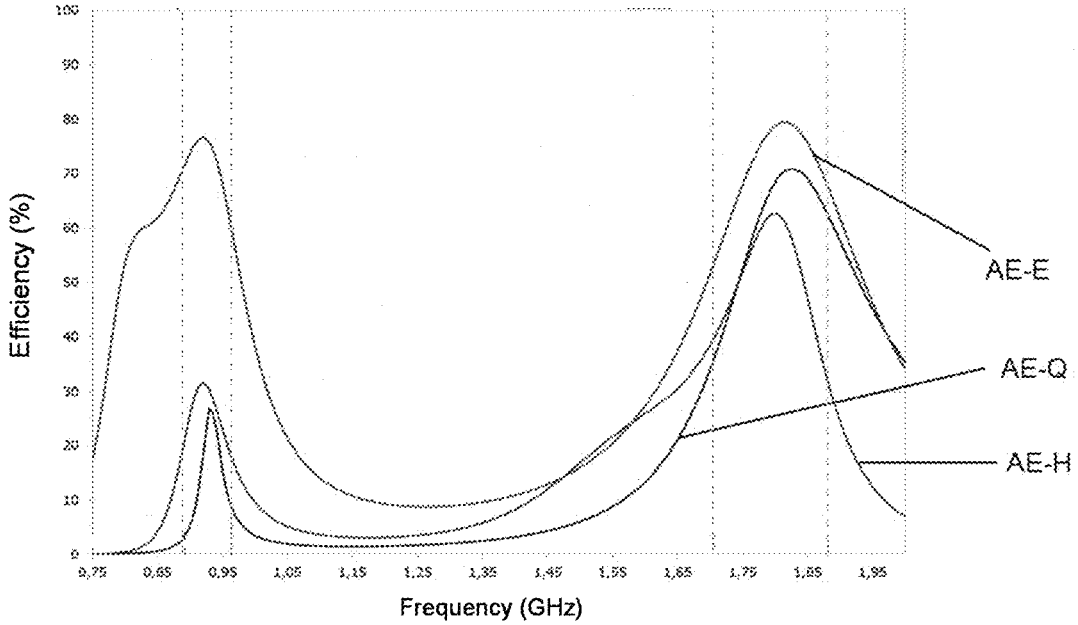
FIG. 23 represents the antenna efficiency related to the three embodiments presented in FIGS. 20*a*-20*c*. The frequency bands that correspond to the bands shown in FIG. 22 are shown in the present figure with dashed lines.

The input reflection coefficients related to the embodiments presented in FIGS. 20*a*-20*c* are provided in FIG. 22 and the related antenna efficiencies are plotted in FIG. 23. Those embodiments are matched at both low frequencies and high frequencies allocated in mobile frequency ranges. The impedance bandwidth achieved at low frequencies around 900 MHz is enlarged when the conductive strip extension features an optimum length that corresponds to the entire length of a 60 mm-diameter round strip. In general, the input reflection coefficient criteria used in the described context to consider that a solution is well matched is an input reflection coefficient below −6 dB or below −4.5 dB in the target frequency band. The antenna efficiency related to the embodiments is considerably improved around 900 MHz for this particular example, and the antenna-efficiency bandwidth is enlarged at those frequencies, adding bands to the device operation like GSM850.

Figure 24A:
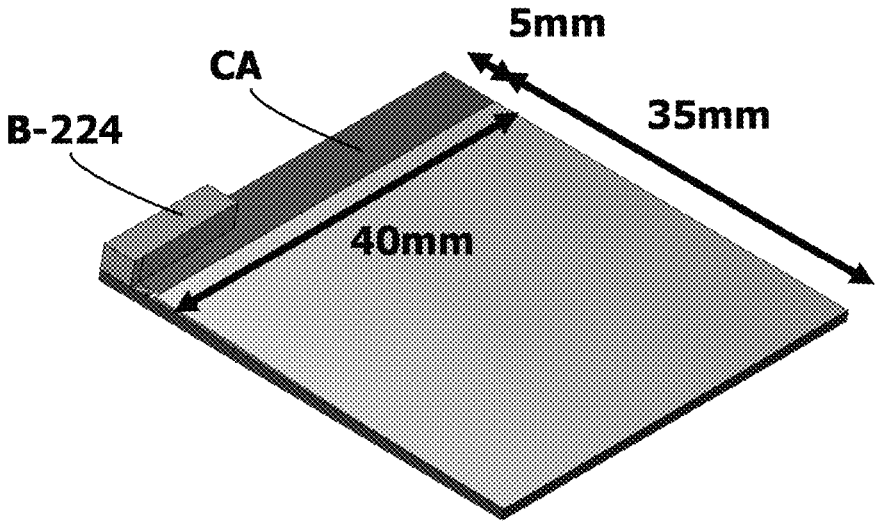
FIGS. 24*a*-24*c* show three embodiments of dimensions 40 mm×40 mm containing a RUN mXTend antenna booster.
Figure 24B:
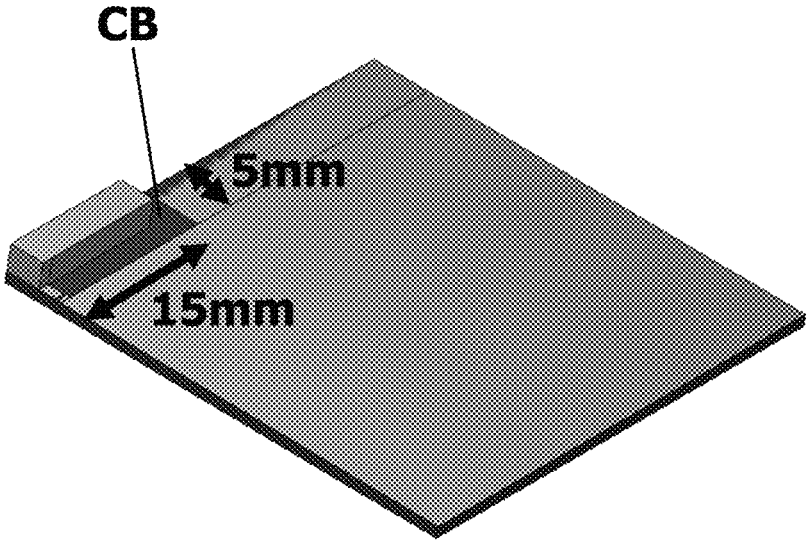
Figure 24C:
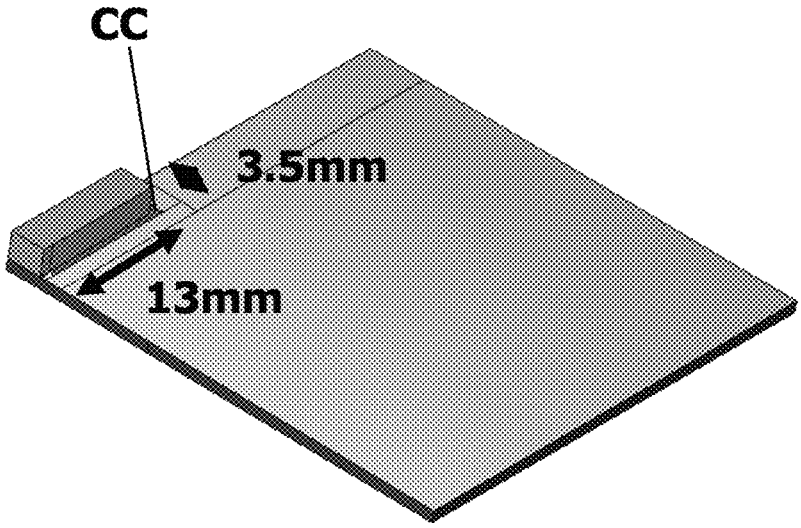
Figure 25:
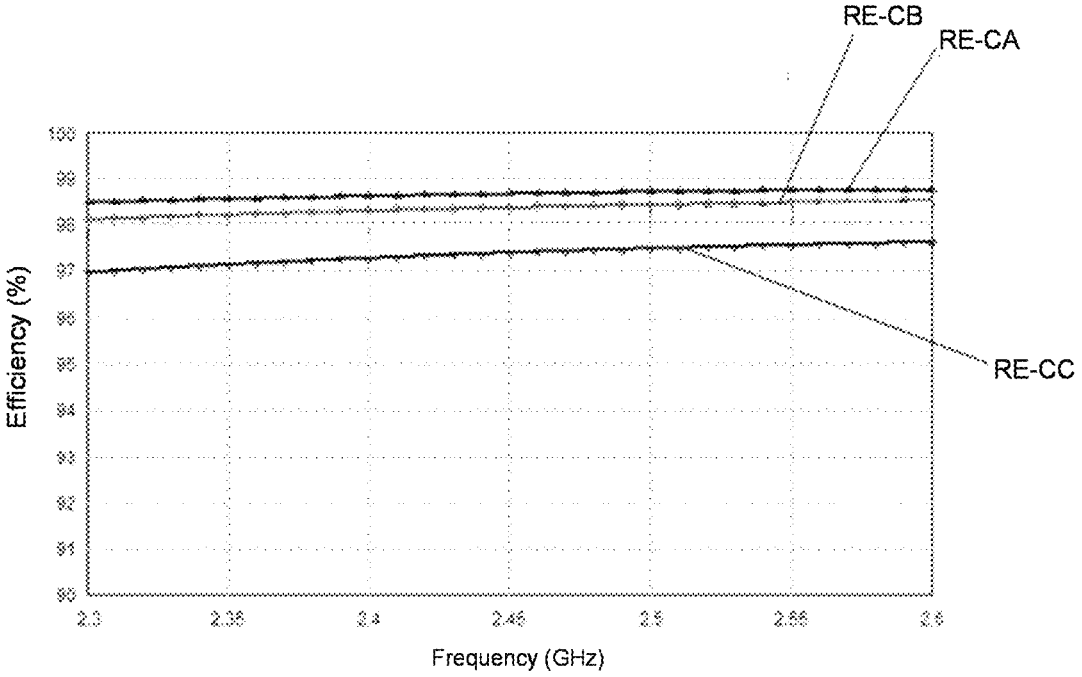
FIG. 25 represents the radiation efficiencies related to the embodiments presented in FIGS. 24*a*-24*c*.

Other embodiments correspond to wearable devices focused on covering diverse applications as for instance health applications, sport applications, elderly-care applications, which normally cover short-range communications. FIGS. 24*a*-24*c* show three different embodiments that include a radiating system arranged as described in FIG. 6*b*. These embodiments improve the space available for placing additional components, by reducing the ground plane clearance, labeled CA, CB and CC in FIGS. 24*a*-24*c* for each of the examples shown, which contains a RUN mXTEND booster B-224, the one illustrated in FIG. 8*b*. The dimensions of the clearances are included in FIGS. 24*a*-24*c*. The radiation efficiencies related to the mentioned embodiments are provided in FIG. 25 and curves RE-CA, RE-CB and RE-CC evidence that the degradation related to the reduction of the clearance is not relevant for this particular configuration and the operation frequencies of operation (plotted in FIG. 25).

Figure 26:
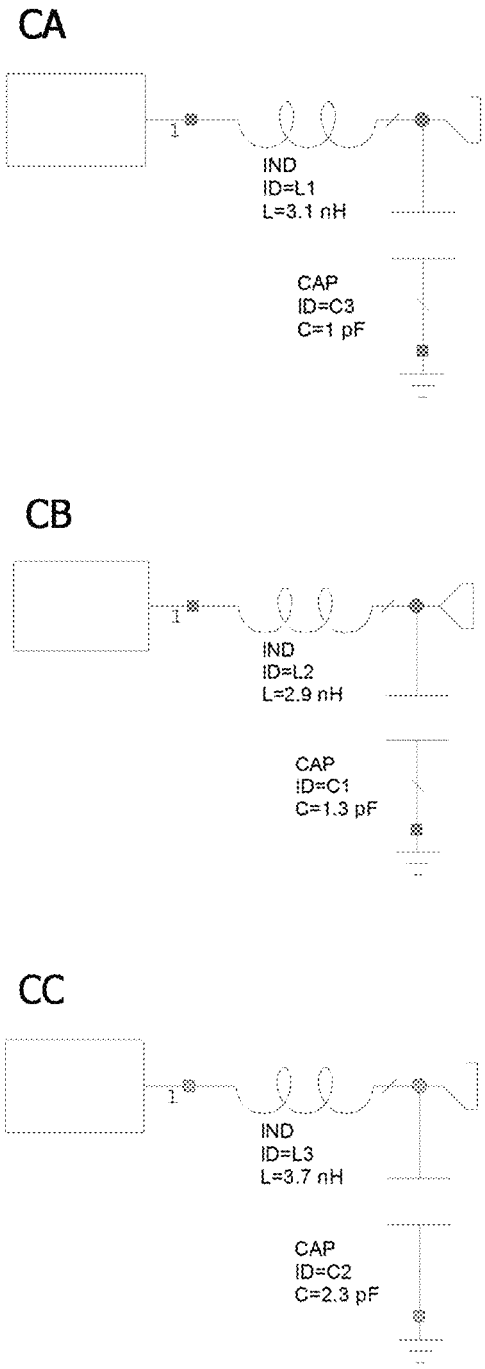
FIG. 26 provides the matching networks used to match the embodiments provided in FIGS. 24*a*-24*c*. Each matching network is labeled as the clearance area related to each embodiment respectively.
Figure 27:
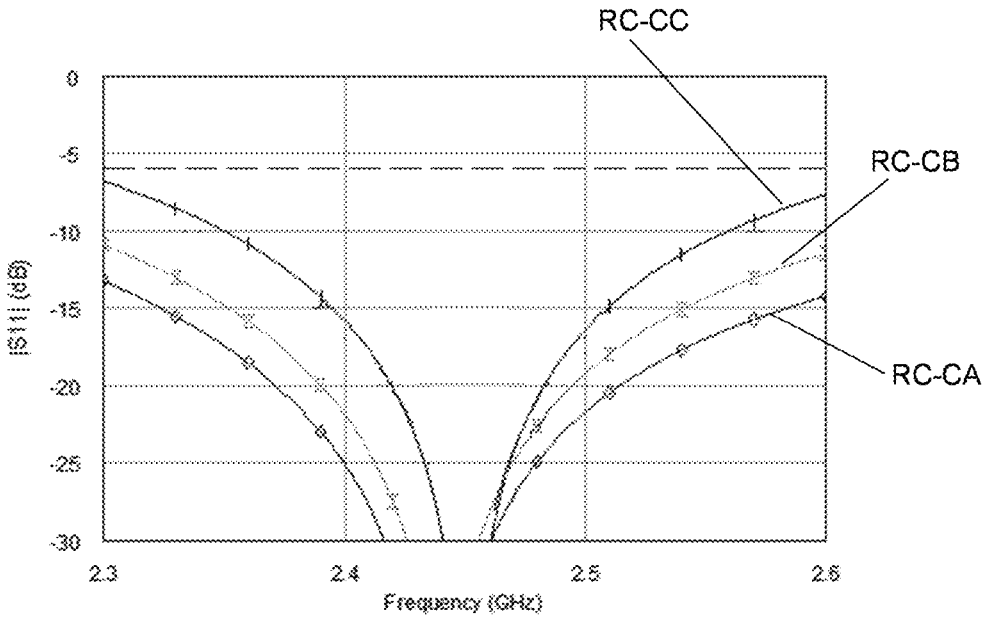
FIG. 27 represents the input reflection coefficients related to the embodiments included in FIGS. 24*a*-24*c* matched with the matching networks included in FIG. 26.
Figure 28:
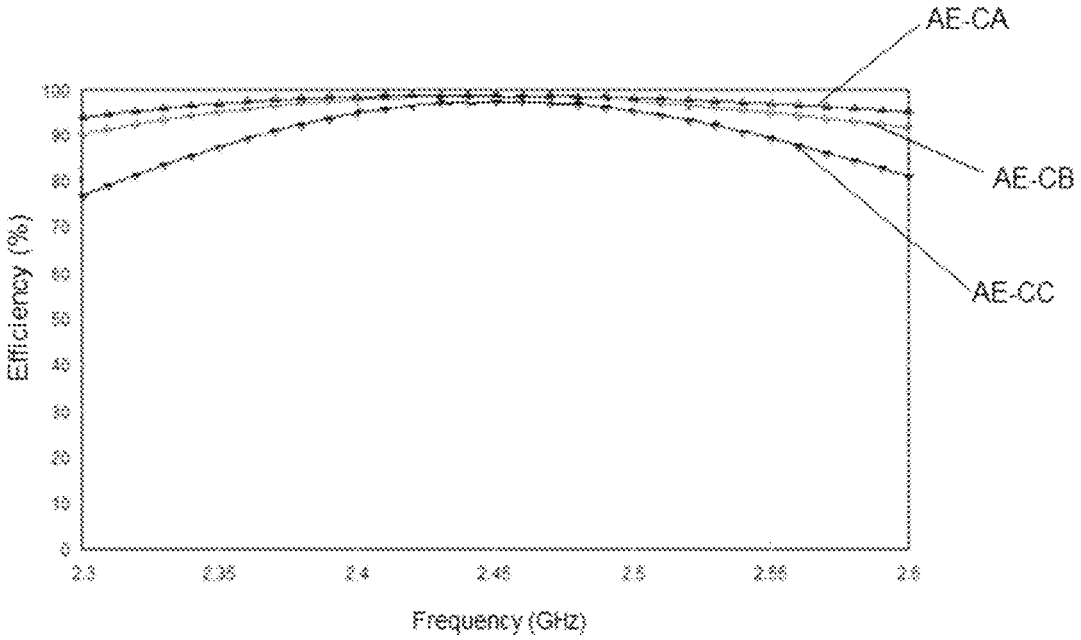
FIG. 28 illustrates the antenna efficiencies related to the embodiments presented in FIGS. 24*a*-24*c* matched with the matching networks included in FIG. 26.

Next, three matching networks used for matching the embodiments provided in FIGS. 24*a*-24*c* are presented in FIG. 26. The matching network topology used for all the examples is the same but the component values used are different. The module of the input reflection coefficients related to the matched embodiments are plotted in FIG. 27. All the embodiments are full well matched below −6 dB in the target frequency bands of operation, for this particular example Bluetooth bands and/or Wifi bands for instance, covering frequency ranges that include 2.45 GHz. In FIG. 28, the antenna efficiencies related to those embodiments are provided. The antenna efficiency performance related to the embodiments featured by the different clearance areas described in FIGS. 24*a*-24*c* remains stable in the target frequency bands, like Bluetooth or Wifi bands, despite the reduction of the ground plane clearance.

Figure 10:
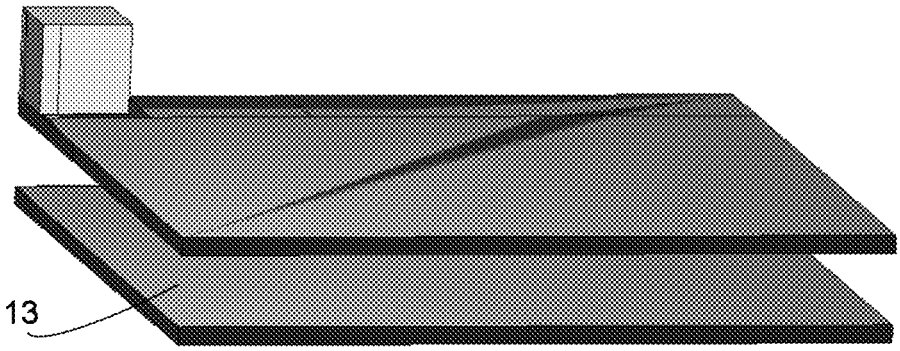
FIG. 10 illustrates an embodiment which comprises a shielding ground plane that is connected to the ground plane layer of the radiating structure.
Figure 29A:
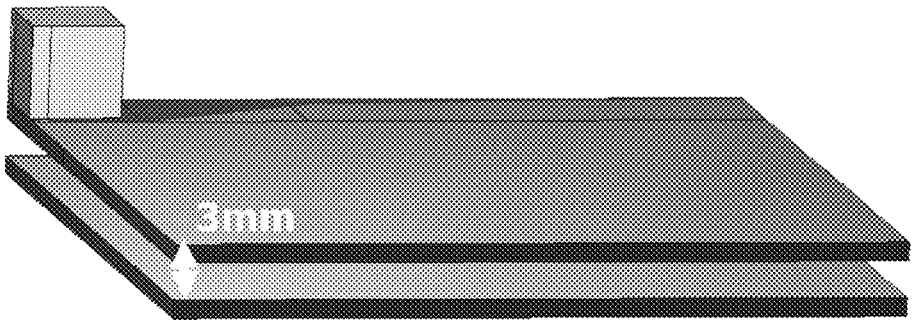
FIGS. 29*a*-29*c* show three different embodiments featured by a radiating structure that contain an additional shielding ground plane placed under a first ground plane layer comprised in the radiating structure comprised in the smart device.
Figure 29B:
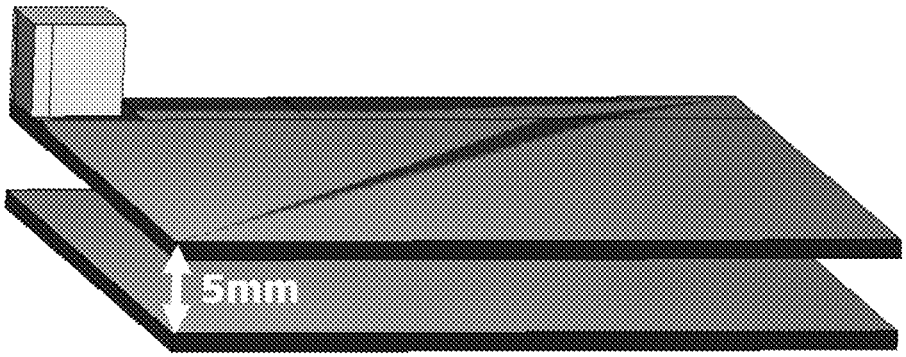
Figure 29C:
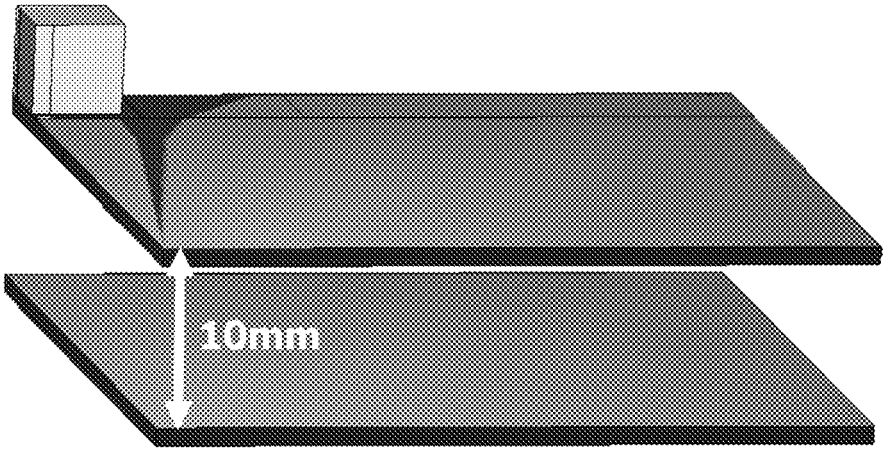

Other embodiments comprise an additional ground plane 13 as shown in FIG. 10 used as shielding. The shielding ground plane is placed at a certain distance from a first ground plane layer included in the radiating structure comprised in the smart wearable device, the first ground plane layer supported by a dielectric material of a certain thickness, which in the particular examples provided in FIGS. 29*a*-29*c* measures 1 mm. In FIGS. 29*a*-29*c*, three embodiments comprising a shielding ground plane in the radiating structure are provided, the additional shielding ground plane placed at 3 mm, at 5 mm or at 10 mm in each example shown in FIG. 29*a*, FIG. 29*b* and FIG. 29*c*, respectively. The booster element included in the embodiments is a CUBE mXTEND booster, with dimensions 5 mm×5 mm×5 mm, included in the mXTEND range of commercial boosters described in http://www.fractusantennas.com/products. The ground plane clearance comprised in the first ground plane layer included in the radiating structure comprised in the embodiments is minimized as shown in FIGS. 29*a*-29*c*.

Figure 30:
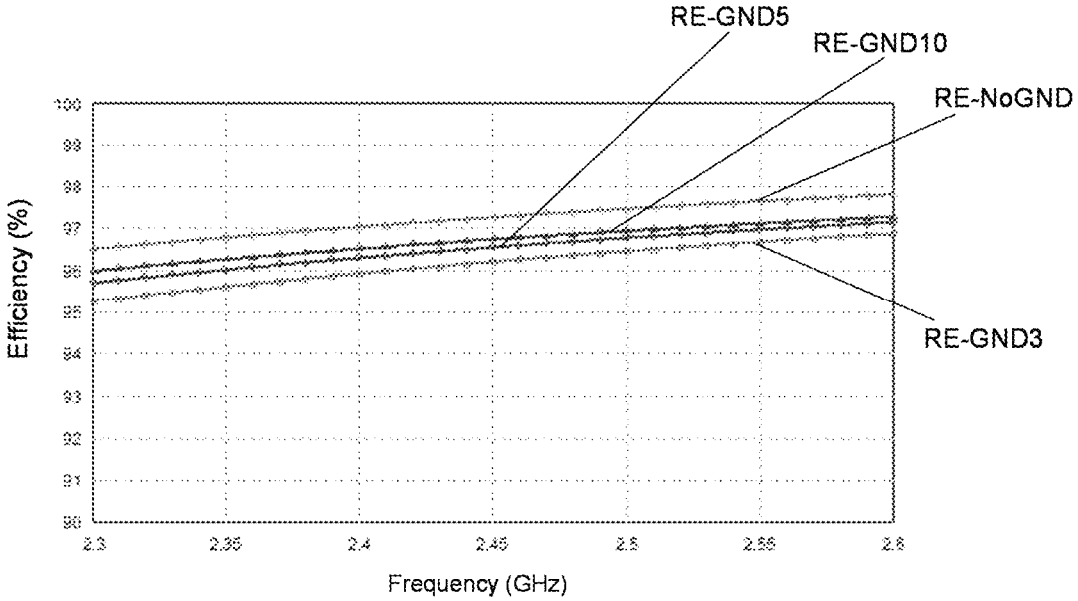
FIG. 30 provides the radiation efficiencies related to the examples provided in FIGS. 29*a*-29*c*.
Figure 31:
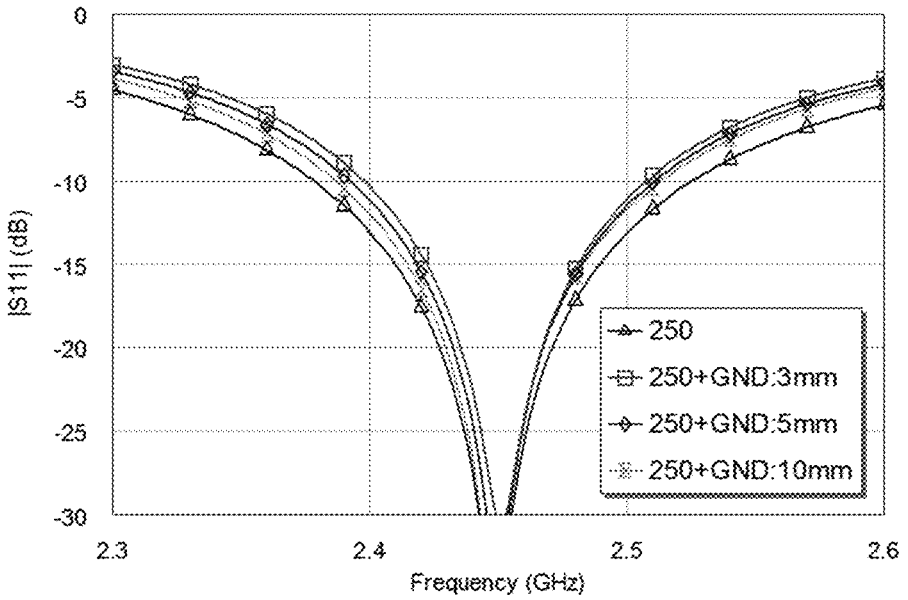
FIG. 31 illustrates the input reflection coefficients related to the examples provided in FIGS. 29*a*-29*c*.
Figure 32:
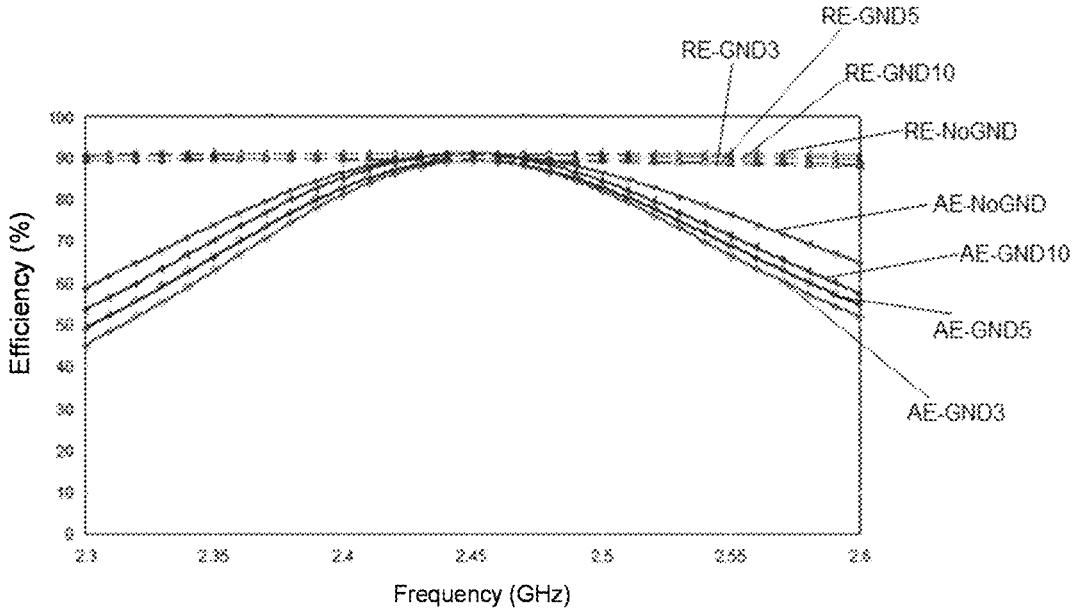
FIG. 32 provides both the radiation and the antenna efficiencies related to matched examples configured as the embodiments shown in FIGS. 29*a*-29*c*.

The radiation efficiencies related to the embodiments presented in FIGS. 29*a*-29*c* are provided in FIG. 30. For comparison purposes, FIG. 30 also contains a curve that represents the radiation efficiency related to an example with the same configuration characteristics and dimensions than the embodiments from FIG. 30 but without shielding ground plane. Such curves show that the radiation efficiency performance remains stable when the shielding ground plane is added to the radiating structure that features the smart wearable device. Next, the input reflection coefficients related to the aforementioned embodiments, once matched, are plotted in FIG. 31 and their corresponding radiation and antenna efficiencies in FIG. 32. The performance in terms of bandwidth and efficiencies achieved at the operation bands of the embodiments, more concretely Bluetooth bands and/or Wifi bands for instance, which cover frequency ranges that comprise the frequency 2.45 GHz, is stable when the shielding ground plane distance is increased, however a slight improvement is evidenced.

Figure 33A:
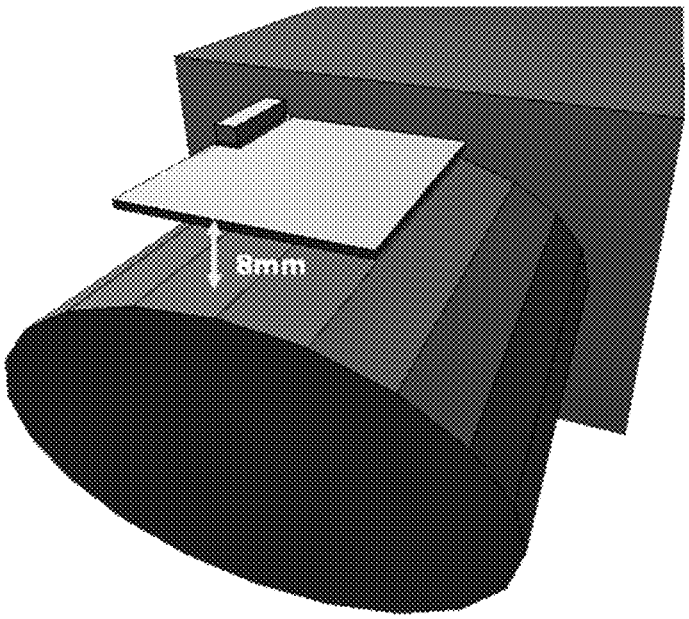
FIGS. 33*a*-33*c* illustrate examples positioned on a simulated phantom hand at 7 mm distance, with a total height of 8 mm from a first ground plane layer contained in the radiating structure to the phantom hand.
Figure 33B:
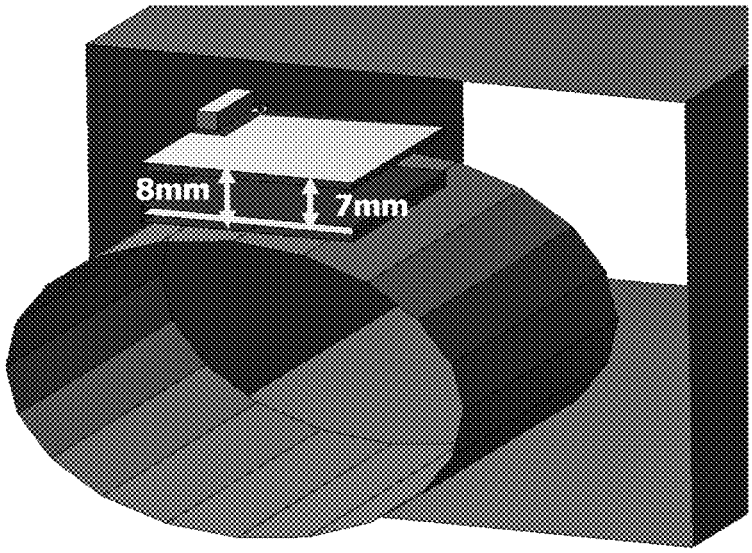
Figure 33C:
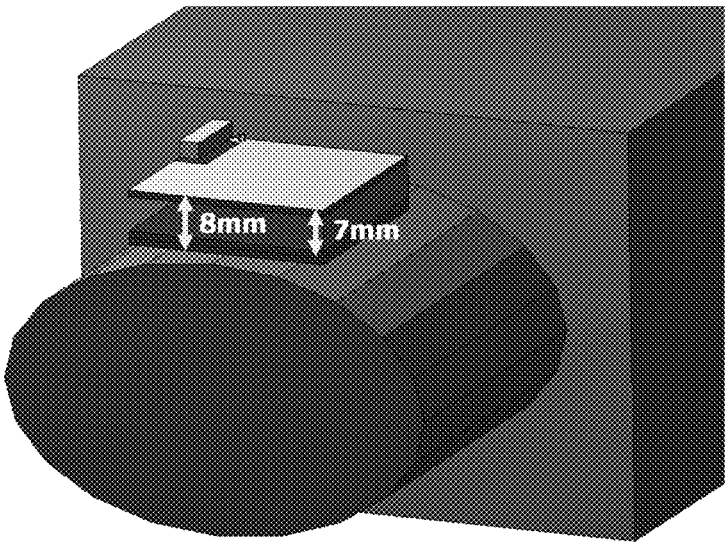
Figure 35:
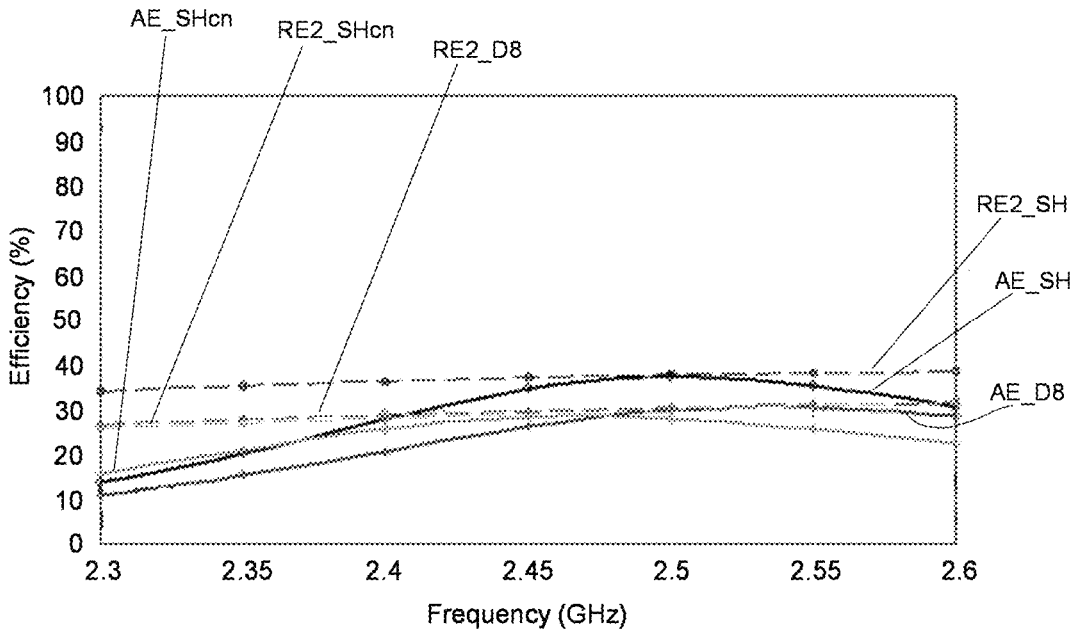
FIG. 35 presents both the radiation and the antenna efficiencies related to the embodiment configurations shown in FIGS. 33*a*-33*c* once matched.

FIGS. 33*a*-33*c* provides examples of configurations placed above a dielectric structure that reproduces a phantom hand. FIG. 33*a* shows an embodiment placed at a certain distance above the dielectric phantom hand. FIG. 33*b* provides a shielded embodiment placed directly above the dielectric phantom hand and FIG. 33*c* shows another shielded embodiment on a dielectric phantom hand wherein the shielding ground plane is connected to the original radiating structure ground plane. FIG. 35 presents the radiation and antenna efficiencies related to the configurations provided in FIG. 33.

Figure 11:
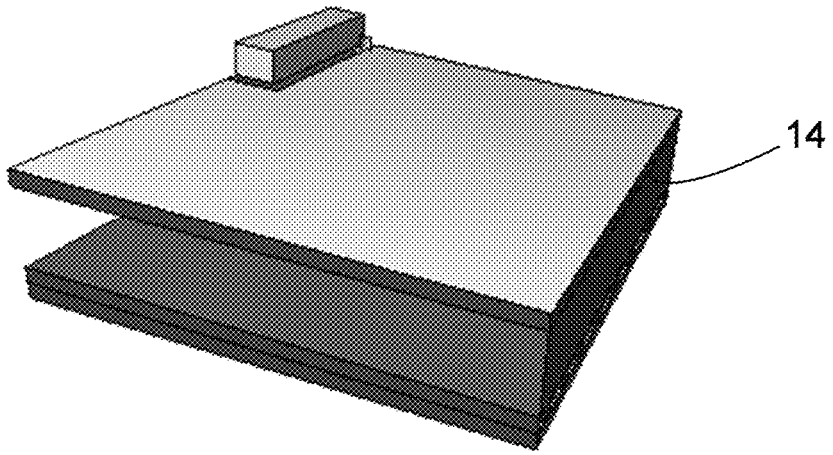
FIG. 11 shows an example that comprises an extended ground plane layer by a conductive element.

Some embodiments further comprise a shielding element 13, which in some of those embodiments the shielding element includes an additional ground plane layer placed between the carrier body and the radiating structure comprised in the wearable device and located at a certain distance from a first ground plane layer comprised in the radiating structure. In some other embodiments, the shielding is connected to the first ground plane layer included in the radiating structure (FIG. 11) by a conductive element. Some of the shielded embodiments comprise at least a strip connection, like for example element 14 shown in FIG. 11, between the shielding ground plane and the first ground plane layer included in the radiating structure. Additionally, the first ground plane layer or layers comprised in some embodiments, shielded or not, is elongated by a conductive element, typically a strip.

Next, some examples of different configurations placed on a dielectric material block that simulates a phantom hand are described. All those embodiments are located at 8 mm from the phantom block. The configuration shown in FIG. 33*a* comprises an arrangement like the one in FIG. 6*b* featured by a minimized ground plane clearance of dimensions 5×14 $mm^2$ that hosts a RUN mXTEND booster (FIG. 8*b*). The dimensions of the ground plane layer contained in the radiating structure are 30 mm width and the maximum length is also 30 mm. In FIG. 33*b*, an arrangement containing a shielding ground plane of 1 mm thickness placed at 7 mm underneath a first ground plane layer contained in the radiating structure that characterizes the smart wearable device is provided. The configuration shown in FIG. 33*c* placed above the dielectric phantom is similar to the one provided in the previous Figure, but the shielding ground plane is connected to the first ground plane layer by a conducting strip.

Figure 34:
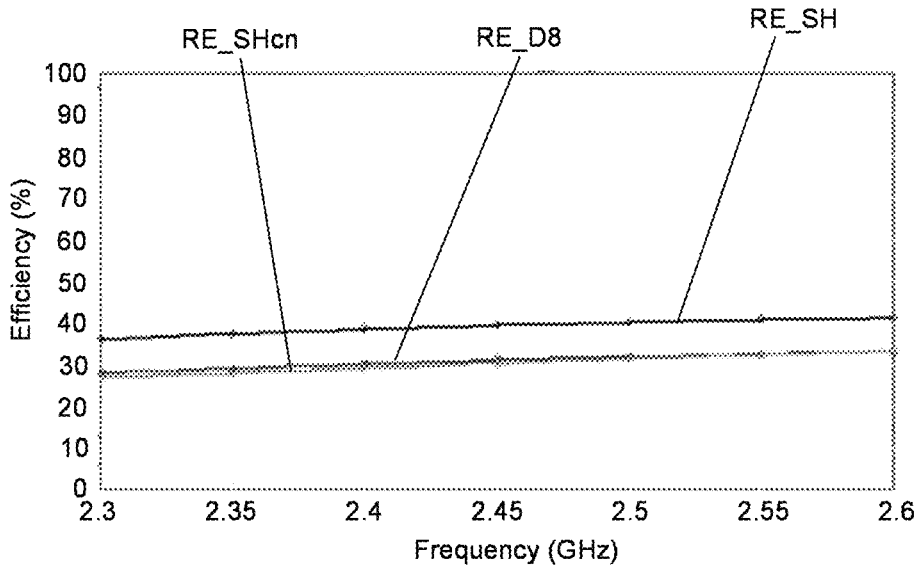
FIG. 34 provides the radiation efficiencies related to the embodiments presented in FIGS. 33*a*-33*c*.

In FIG. 34, the radiation efficiencies related to the specific embodiments presented in FIGS. 33*a*-33*c* are provided. The distance between the device structure and the phantom hand has an impact on the input impedance and the radiation efficiency. The smaller the distance the lower the radiation efficiency. The radiation efficiency related to the on-body arrangement shown in FIG. 33*a* is improved when a shielding ground plane is added to the radiating structure include in the wearable device. However, the radiation performance related to an arrangement wherein the shielding ground plane is connected to the ground plane layer included in the device radiating structure by a conductive strip is similar to the radiation efficiency related to the configuration presented in FIG. 34, in which the radiating structure is placed at the same distance from the phantom dielectric but does not include a shielding ground plane between them.

FIG. 35 shows the radiation and the antenna efficiencies related to the embodiments presented in FIGS. 33*a*-33*c*, once matched. The radiation efficiencies are plotted with dashed lines and the corresponding antenna efficiencies with solid lines. Among the configurations compared in FIG. 35, the arrangement that includes a shielding ground plane under the original structure, which comprises a first ground plane layer in the radiating structure that is included in the wearable device, is the one that features better antenna efficiency values in the target frequency range or ranges, comprising Bluetooth bands and/or Wifi bands for example. However, the other embodiments are also good solutions for operating on a carrier living body, providing also adequate antenna efficiencies in such operation environments as shown in FIG. 35.

Although some examples of smart wearable devices featuring a radiating system arrangement that comprises at least a non-resonant element, such as for instance those described herein are provided, other non-resonant element arrangements could have been constructed.

What is claimed is:

1. A wearable device comprising:

a radiating system operable in at least one operating frequency band contained within at least one frequency region, the at least one operating frequency band extending from a first frequency to a highest frequency of operation of the radiating system, the radiating system comprising:

a radiating structure comprising:

at least one booster element including a top conducting surface contained in a dielectric material support, the at least one booster element having a maximum booster length; and a ground plane layer having a maximum ground plane layer length greater than the maximum booster length, wherein the at least one booster element and the ground plane layer are disposed in an arrangement having a maximum radiating structure length less than 0.8 times a free space wavelength corresponding to the highest frequency of operation of the radiating system; and a matching network to enable operation of the radiating system in the at least one operating frequency band.

2. The wearable device of claim 1, wherein the first ground plane layer comprises a ground plane clearance that contains the at least one booster element.

3. The wearable device of claim 2, wherein the at least one booster element is placed at a distance from an edge of the ground plane layer.

4. The wearable device of claim 2, wherein the radiating structure further comprises a shielding ground plane layer.

5. The wearable device of claim 4, wherein the shielding ground plane layer is connected to the ground plane layer by a conductive element.

6. The wearable device of claim 1, wherein the ground plane layer not include a ground plane clearance containing the at least one booster element.

7. The wearable device of claim 1, wherein the at least one booster element is placed above the ground plane layer.

8. The wearable device of claim 7, wherein the maximum radiating structure length is less than 0.16 times a free-space wavelength corresponding to the highest frequency of operation.

9. The wearable device of claim 7, wherein the maximum radiating structure length is less than 0.125 times a free-space wavelength corresponding to the highest frequency of operation.

10. The wearable device of claim 1, wherein the maximum radiating structure length is less than 0.4 times a free-space wavelength corresponding to the highest frequency of operation.

11. The wearable device of claim 1, wherein the maximum radiating structure length is less than 0.3 times a free-space wavelength corresponding to the highest frequency of operation.

12. The wearable device of claim 1, wherein the top conducting surface of the at least one booster element is connected to at least one via.

13. The wearable device of claim 12, wherein one of the at least one via is a feeding element.

14. The wearable device of claim 12, wherein the at least one booster element further includes at least one bottom conducting surface and the at least one via connects the top conducting surface to the at least one bottom conducting surface.

15. The wearable device of claim 14, wherein the at least one bottom conducting surface is contained in the dielectric material support that contains the top conducting surface.

16. The wearable device of claim 1, wherein the first ground plane layer is extended by at least one conducting strip element.

17. The wearable device of claim 16, wherein the radiating system is configured to operate in at least one low-frequency band within a 880 MHz to 960 MHz frequency range.

18. The wearable device of claim 17, wherein the top conducting surface of the at least one booster element is connected to at least one via.

19. The wearable device of claim 18, wherein the at least one booster element further includes at least one bottom conducting surface and the at least one via connects the top conducting surface to the at least one bottom conducting surface.

* * * * *